US006520745B1

(12) United States Patent
Yamamoto et al.

(10) Patent No.: US 6,520,745 B1
(45) Date of Patent: Feb. 18, 2003

(54) PERFORMANCE REGULATING DEVICE FOR FLUID MACHINERY

(75) Inventors: Masakazu Yamamoto, Tokyo (JP); Yoshio Miyake, Tokyo (JP); Junya Kawabata, Tokyo (JP); Keita Uwai, Tokyo (JP); Yoshiaki Miyazaki, Tokyo (JP); Katsuji Iijima, Tokyo (JP); Makoto Kobayashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/623,594

(22) PCT Filed: Feb. 26, 1999

(86) PCT No.: PCT/JP99/00945

§ 371 (c)(1),
(2), (4) Date: Oct. 17, 2000

(87) PCT Pub. No.: WO99/45273

PCT Pub. Date: Sep. 10, 1999

(30) Foreign Application Priority Data

Mar. 4, 1998 (JP) ..... 10-69352
Jun. 9, 1998 (JP) ..... 10-176581

(51) Int. Cl.[7] ..... F04B 49/06
(52) U.S. Cl. ..... 417/44.1
(58) Field of Search ..... 417/44.1, 1, 41, 417/369; 318/808, 762; 361/141; 165/151; 277/593

(56) References Cited

U.S. PATENT DOCUMENTS 4,743,826 A * 5/1988 Bando et al. ..... 318/762
4,908,757 A * 3/1990 Jensen et al. ..... 363/141
4,909,219 A * 3/1990 Perr et al. ..... 123/456
5,018,665 A * 5/1991 Sulmone ..... 236/93 A
5,332,369 A * 7/1994 Jensen ..... 417/369
5,345,763 A * 9/1994 Sato ..... 60/290
5,563,490 A * 10/1996 Kawaguchi et al. ..... 318/808
5,667,362 A * 9/1997 Murai et al. ..... 417/41
5,833,503 A * 11/1998 Kallio ..... 440/88
6,113,820 A * 9/2000 Lyzinski et al. ..... 264/36.15
6,125,925 A * 10/2000 Obosu et al. ..... 165/151
6,265,786 B1 * 7/2001 Bosley et al. ..... 290/52
6,299,175 B1 * 10/2001 Maekawa et al. ..... 277/593

FOREIGN PATENT DOCUMENTS

JP 7-253161 * 10/1995

* cited by examiner

*Primary Examiner*—Teresa Walberg
*Assistant Examiner*—Daniel Robinson
(74) *Attorney, Agent, or Firm*—Oblon, Spivak, McClelland, Maier & Neustadt, P.C.

(57) ABSTRACT

An apparatus for controlling performance of a fluid machinery by controlling rotational speed of the fluid machinery. A performance regulating device for the fluid machinery includes a frequency converter, a casing for housing the frequency converter so as to ensure being airtight against an atmosphere, an input, and an output connected to the casing so as to ensure being airtight against the atmosphere.

23 Claims, 22 Drawing Sheets

PERFORMANCE REGULATING DEVICE FOR FLUID MACHINERY

BACKGROUND OF THE INVENTION

1. Field of the Invention

The present invention relates to a performance regulating device for a fluid machinery, more particularly to a performance regulating device for a fluid machinery, which is suitably used for the pump for circulating cool or hot water.

2. Discussion of the Background

The method for controlling rotation speed of a motor pump through an inverter device (frequency converter) is well known in the art. This method can be very effective means for energy saving in the application of the pump for supplying water and so on in which a violent fluctuation of load is occurred, as well as in the application of the pump for circulating water.

A general purpose pump is not manufactured according to a specific standard specification, but is selected according to required specification. Namely, the general purpose pump is not order-made product which satisfy a specific specification (flow rate, pump head), but is selected from inventory for use so as to satisfy the scheduled specification. Additionally, the scheduled specification is generally calculated so as to satisfy a maximum flow rate in view of enough margin of expected flow rate. The head loss of the piping will be determined in view of enough margin and aged deterioration. Accordingly, when the pump is operated actually, the valves are controlled for suppressing the over flow rate, thus resulting to a waste of the energy. Even if the pump is selected in accordance with a calculation with calculating formulae, more or less waste of energy will be occurred.

In order to save energy, it is necessary to operate the pump in accordance with the "true" specification, thus realizing effective operation of the pump without energy loss. The "true" specification is only acquired after actual operation of the pump is carried out on the site, where actually required lowest flow rate and pump head can be found merely by operating the pump.

When it is found by the operation of the pump on the site that the capacity of the pump is too large, the energy can be saved by the following countermeasures:

(1) exchanging the pump with a pump of one rank reduced capacity; and (2) reducing the outer diameter of the impeller to reduce the performance of the pump to the suitable value.

However, these countermeasures require additional cost, and it is difficult to retrieve the performance of the pump of thus reduced performance. On the contrary, the inverter device can control the performance of the pump easily and retrievably, so that the pump can be operated to save energy in accordance with the situation of the site without requiring above mentioned countermeasures.

In a case of incorporating an inverter device into an existing pump on a site, the energy can be saved by the following manners, which has advantages and disadvantages as follows:

(1) A Method for Controlling the Existing Motor Pump by Additionally Installed Inverter (Advantage)

It is unnecessary to alter the motor pump itself.

(Disadvantage)

Generally, the circumstances in which the pump is installed are humid and unsuitable for additionally installing the inverter device. In this view point, it is preferable to incorporate the inverter device into the control console for controlling the motor pump. It is thus necessary to modify the existing control console or to construct new control console for incorporating the inverter device.

(2) A Method for Exchanging the Existing Motor Pump with a Motor Pump Incorporating an Inverter Device (Advantage)

Any modification of the control console is substantially unnecessary.

(Disadvantage)

In this method, it is necessary to exchange the motor pump wholly. The exchanging of the existing pump before reaching the end of its service life is disadvantageous in respect of the cost.

(3) A Method for Exchanging the Motor Portion of the Existing Pump with a Motor Incorporating an Inverter Device (Advantage)

Only exchanging the motor portion is required. However, disassembling operation and reassembling operation of the pump portion is also required except for a pump of directly coupling type. It is substantially unnecessary to modify the control console.

(Disadvantage)

Exchanging of the existing motor before the limit of its service life is disadvantageous in respect of the cost.

SUMMARY OF THE INVENTION

In view of the above mentioned problems, the present invention provides a technology that performance regulating of pump is easily carried out, and the energy to be consumed thereby is reduced. Namely, it is an object of the present invention to provide a performance regulating device for fluid machinery that without requiring any modification or change of existing pumps or existing control consoles, merely adding an inverter device can enable performance regulating of the pumps so as to save energy.

To achieve above object, according to an aspect of the present invention, there is provided.

In accordance with the present invention, the frequency converter is sealed completely against the atmosphere, so that the humidity around the pump and the rain do not affect the frequency converter. Further, the degradation of the insulation resistance due to the condensation of water within the casing can be avoided, even if the water cooling structure as mentioned below is adopted.

The submerged cable may be used as input means and output means. In such cable, the clearance between the core and the insulation is sealed hermetically, and the clearance between the insulation and the covering is also sealed hermetically.

The present invention is most effective when the fluid machinery is a motor pump of turbo type. The condensation of water can be avoided when the frequency converter is cooled by liquid to be handled by the pump. The condensation of water may be occurred with the casing due to cooling by the circulation of the cooled water especially in summer season. Further, an air cooling fan used in the general purpose inverter device is not required.

According to an aspect of the present invention, heat radiating means is provided for transferring a heat generated by the frequency converter to a pipe to be connected to the pump through the surface of the pipe. Thus the heat generated by the frequency converter can be radiated to the fluid, which is handled by the pump.

According to an aspect of the present invention, heat radiating means is provided on the casing, and a flow passage is provided through the heat radiating means for passing a fluid to be handled by the pump. At a result, the heat generated by the frequency converter is radiated effectively by the fluid, which is handled by the pump.

According to an aspect of the present invention, heat radiating means is provided on a casing, and a flow passage is provided through said heat radiating means for passing a fluid, which is handled by the pump. Here, heat radiating means is a water cooling heat sink of stainless steel to which the liquid to be handled by the pump is introduced through a bypass pipe (tube).

According to an aspect of the present invention, a heat radiating plate of air cooling type is provided on the casing of the frequency converter. The heat radiating means can be formed by the coupling guard made of aluminium alloy. Air stream generated by the rotation of the coupling is directed to flow against the coupling guard to cool it. The coupling guard is provided with a plurality of air cooling fins.

According to an aspect of the present invention, a switch is provided by which the output frequency can be varied in stepwise manner, for example in 8 steps by 5% each. At a result, the switch allows the user to regulate the performance of the fluid machinery easily. The switch is not a volume control dial of analogue type, so that the switching between steps can reliably be effected. When the volume control dial is employed, means for displaying the output frequency, for example, a liquid crystal monitor is required. Namely, control operation of the volume control dial does not show real operational condition of the pump, for example, rotational speed of the pump. On the other hand, the stepwise switch select one of the positions hereof corresponding to the preliminary certified operational condition, so that the performance of the pump can be regulated reliably, easily, and reproducibly.

According to an aspect of the present invention, the casing for housing the frequency converter is commonly used with a frequency converter assembly to be mounted on the outer surface of the pump and cooled by water. At a result, a pump with inverter device can be delivered to the application of newly constructed pumping facility. With respect to the existing pumping facility before limit of its service life, the performance regulating device as an flow rate control means can be supplied to the market with high productivity and low cost.

According to an aspect of the present invention, the performance regulating device is constructed that the frequency converter begins to output electrical power automatically when electric power is supplied thereto. This means that the fluid machinery can be started merely by making the power switch "on" on the control console, so that the performance regulating device can be mounted anywhere, when the device is mounted on a pipe. For example, the regulating device can be mounted with taking the children's play into consideration, or can be mounted at a narrow limited space.

The present invention can be utilized not only as a performance regulating device for a fluid machinery, but also as a frequency converter for controlling the rotational speed of general machine including a motor. Further, the device of the present invention can effectively be used in the out door condition of under rain weather since the casing is sealed hermetically.

The frequency converter of the present invention does not require an air cooling fan, which is used in the general purpose inverter. Thus, malfunction of the fan can be avoided, and stop of cooling is prevented.

In the second embodiment of the present invention, there is provided a performance regulating device for a fluid machinery comprising a frequency converter, typically an inverter device, a casing for housing the frequency converter, input means and output means connected to the casing, and an output frequency regulating device, wherein the casing of the performance regulating device for the fluid machinery is of weather proof structure avoiding the ingress of the rain water into the casing.

The inverter devices of relatively small output are often of air cooling without blower type. These inverter devices does not require the water cooled structure, so that no countermeasures against the condensation of water is required. However, the pumping facility are often provided on the out door condition, so that it is desirable to make the inverter devices to have weather proofness.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7A is a side view showing the whole construction of the fluid machinery, and FIG. 7B is an elevational view seen from the direction of the arrow VII;

FIG. 8A is an elevational view, and FIG. 8B is a side view;

FIG. 15A is an elevational view in partly cross section, and FIG. 15B is a side view;

FIG. 16A is an elevational view in partly cross section, and FIG. 16B is a side view;

FIG. 17A is an elevational view in partly cross section, and FIG. 17B is a side view;

FIG. 19 is a view corresponding to FIGS. 8A and 8B;

FIG. 20A is an exploded view of the unit as shown in FIG. 19, and 20B is a perspective view of the thin plate 90;

FIG. 22A is an elevational view and FIG. 22B is a side view.

DESCRIPTION OF THE PREFERRED EMBODIMENTS

A performance regulating device for a fluid machinery according to an embodiment of the present invention will now be described with reference to the drawings.

Figure 1:
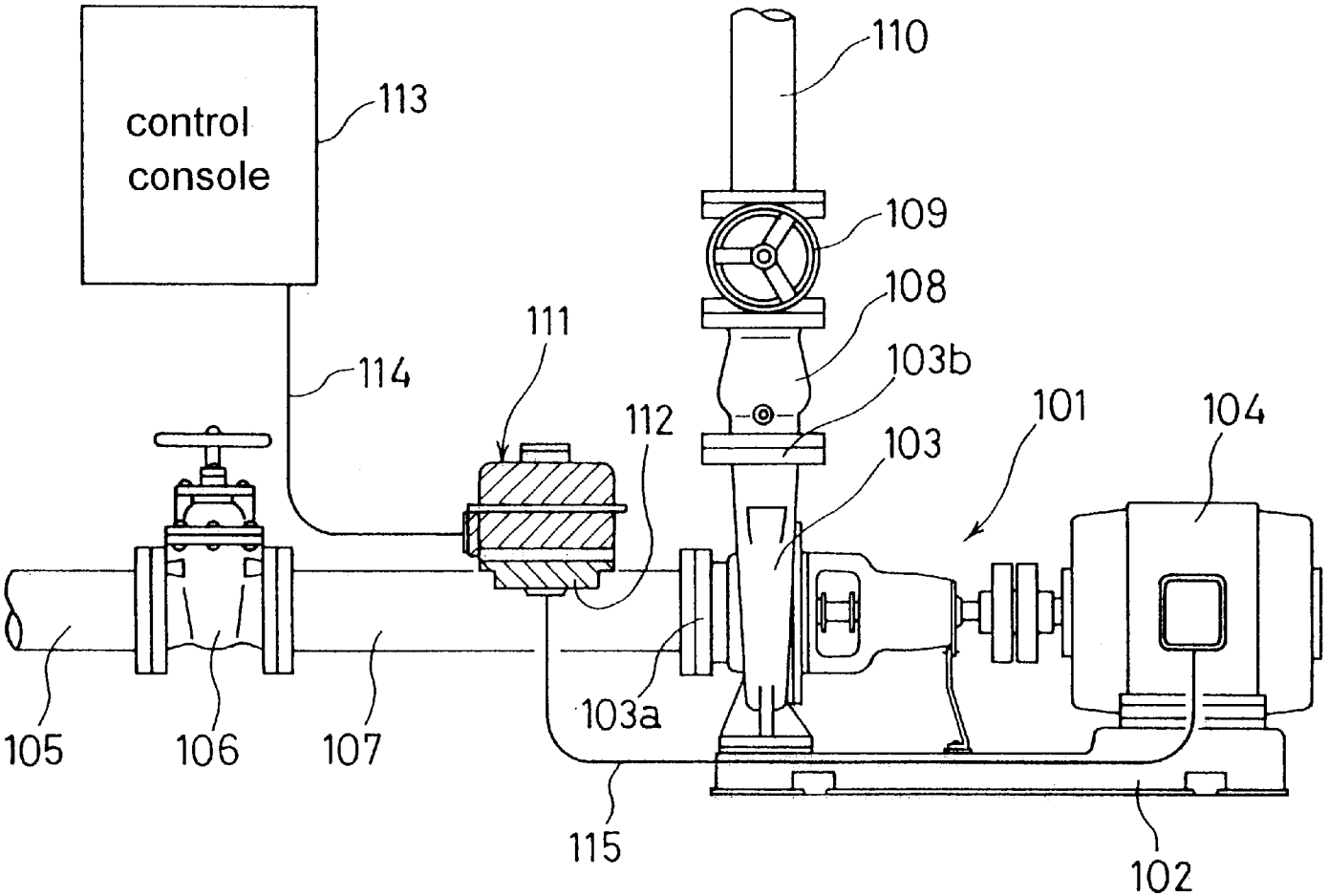
FIG. 1 is a side view of the arrangement of the first embodiment in which the performance regulating device for fluid machinery of the present invention is employed.

The first embodiment of the performance regulating device, which is mounted on a fluid machinery in accordance with the present invention is shown in FIG. 1. A pump unit designated by reference numeral 101 comprises a pump 103 and a motor 104 mounted on a common base 102. The fluid introduced through a suction pipe 105 flows through a gate valve 106 provided on a suction side and a short pipe 107, and via an inlet port 103*a* of the pump into the pump 103, and increased in its pressure by the pump, and then delivered from an outlet port 103*b* of the pump. The delivered fluid is then introduced to a delivery pipe 110 through an check valve 108 and a gate valve 109 provided on a discharge side.

The performance regulating device (referred to as the regulating device hereinbelow) 111 for a fluid machinery is mounted on the short pipe 107 through a heat radiating means 112 of aluminium alloy, which has good thermal conductivity.

In the arrangement of this embodiment, the heat radiating means 112 is fixedly secured to the regulating device 111 through bolts (not shown), and fixedly secured on the short pipe 107 by U-bolts (not shown).

Electric power supplied from a control console 113 is applied from an input cable 114 as an input means of the regulating device 111 to a frequency converter in the regulating device 111, which converts the frequency of the supplied electric power. The electric power whose frequency has been converted is supplied from an output cable 115 as an output means of the regulating device 111 to the electric motor 104. The frequency converter in the regulating device 111 causes a heat loss, which is radiated into the liquid handled by the pump via the heat radiating means 112 and the short pipe 107.

Figure 2:
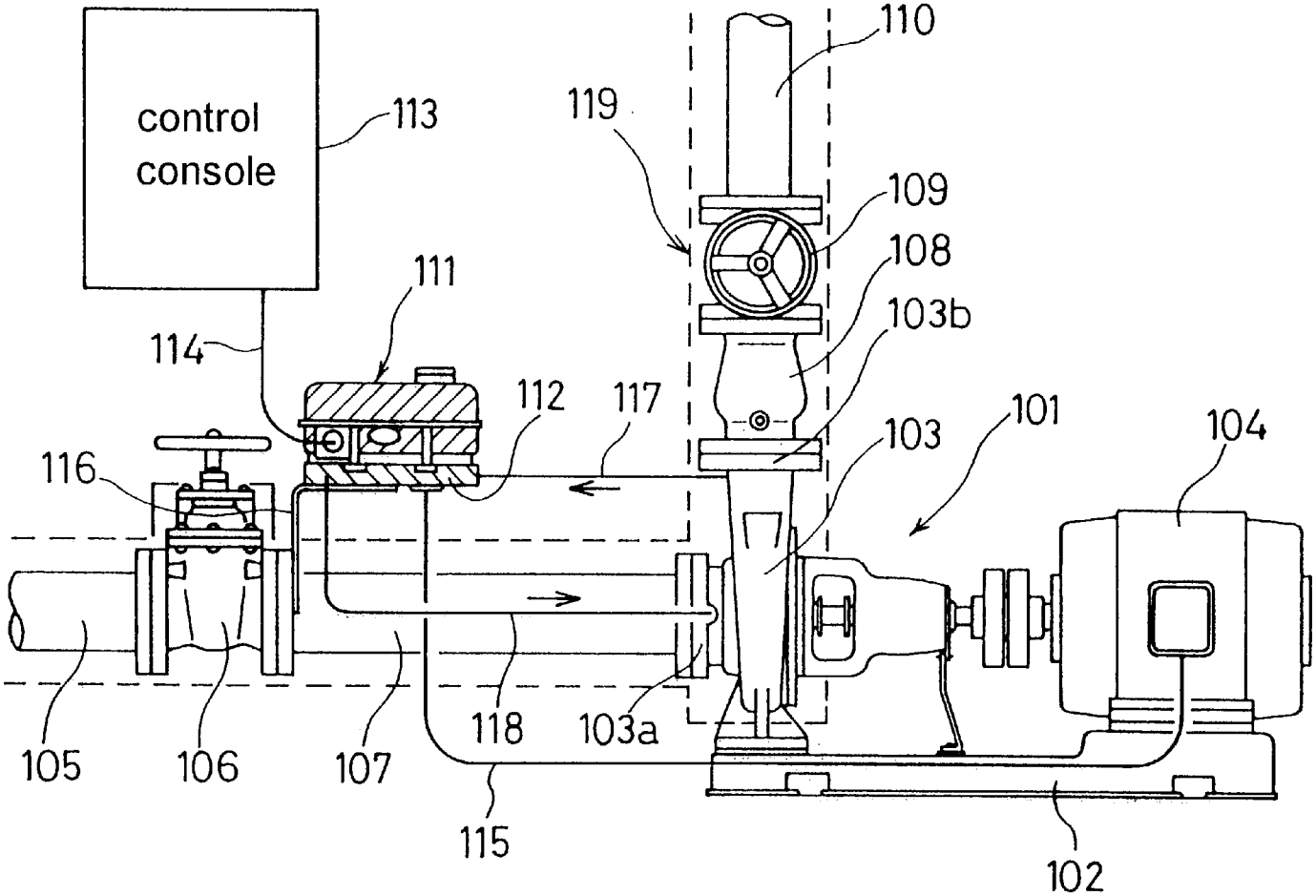
FIG. 2 is a side view of the arrangement of the second embodiment in which the performance regulating device for fluid machinery of the present invention is employed.

The second embodiment of the regulating device, which is mounted on a fluid machinery in accordance with the present invention is shown in FIG. 2. A pump unit designated by reference numeral 101 comprises a pump 103 and a motor 104 mounted on a common base 102. The fluid introduced through a suction pipe 105 flows through a gate valve 106 provided on a suction side and a short pipe 107, and via an inlet port 103*a* of the pump into the pump 103, and increased in its pressure by the pump, and then delivered from an outlet port 103*b* of the pump. The delivered fluid is then introduced to a delivery pipe 110 through an check valve 108 and a gate valve 109 provided on a discharge side.

Electric power supplied from a control console 113 is applied from an input cable 114 as an input means of the regulating device 111 to a frequency converter in the regulating device 111, which converts the frequency of the supplied electric power. The electric power whose frequency has been converted is supplied from an output cable 115 as an output means of the regulating device 111 to the electric motor 104.

In the second embodiment of the present invention as shown in FIG. 2, the heat radiating means 112 comprises of a water cooled jacket of stainless steel secured to the regulating device 111 by means of bolts (not shown). The heat radiating means 111 is fixedly secured through a L-shaped fixture on the flange of the short pipe 107 by a bolt employed in connecting the short pipe 107 to the gate valve 106. A fluid is introduced into the heat radiating means 112 through a small pipe 117 from the discharge side of the pump. The fluid is then bypassed through a small pipe 118 into the suction side of the pump.

In this embodiment, the heat loss produced inevitably with the frequency conversion is radiated through the heat radiating means 112 and small pipes 117, 118 into the fluid handled by the pump.

In the arrangement as shown in FIG. 2, a thermal insulation is provided as shown by a dotted line 119. According to the thermal insulation, heat moving phenomena from the surface of the pipes into ambient air is prevented in circulating system of cooled or heated water and so on. While it is difficult to adopt the regulating device of first embodiment shown in FIG. 1, since it is not appropriate to mount the regulating device 111 within the thermal insulation 119, thus the regulating device of the second embodiment is effective on such application having thermal insulation.

Figure 3A:
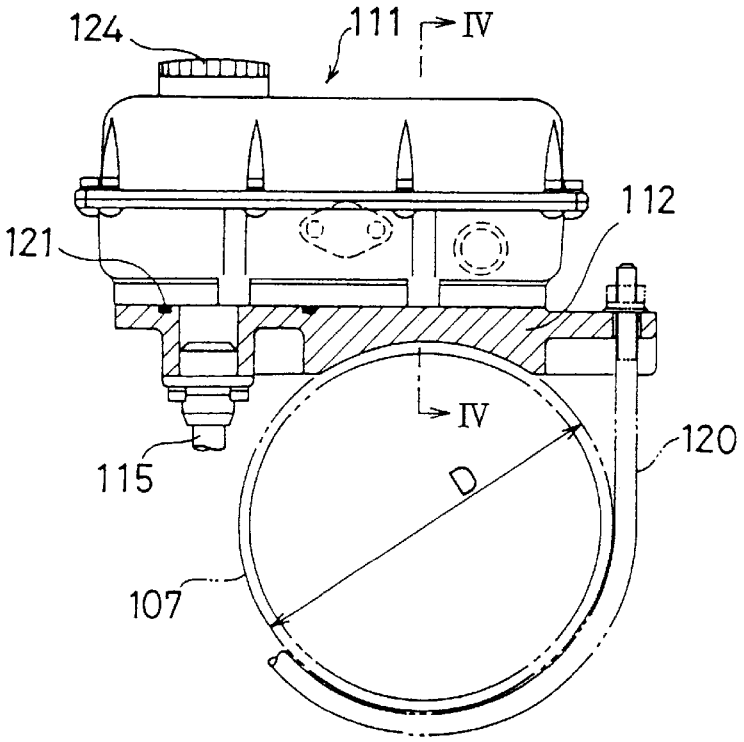
FIG. 3A is a detailed elevational view in partly cross section of the arrangement as shown in FIG. 1.
Figure 3B:
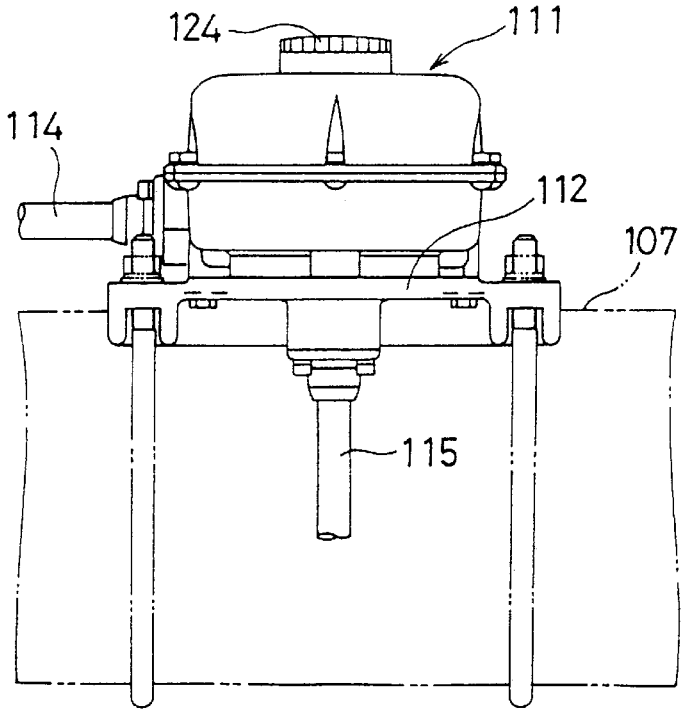
FIG. 3B is a detailed side view of the arrangement as shown in FIG. 1.

FIGS. 3A and 3B show the regulating device shown in FIG. 1 in detail. FIG. 3A is a front elevational view, partly in cross section, of the regulating device, and FIG. 3B is a side elevational view of the regulating device.

The heat radiating means 112 is fixed to the short pipe 107 by U-bolts 120. The input cable 114 and the output cable 115 keep the regulating device 111 hermetically sealed from the atmosphere in the same manner as with an underwater cable of a submersible motor pump, for example. An O-ring 121 is disposed to prevent ambient air from entering the regulating device through the mating surface between the heat radiating means 112 and the regulating device 111.

Figure 4:
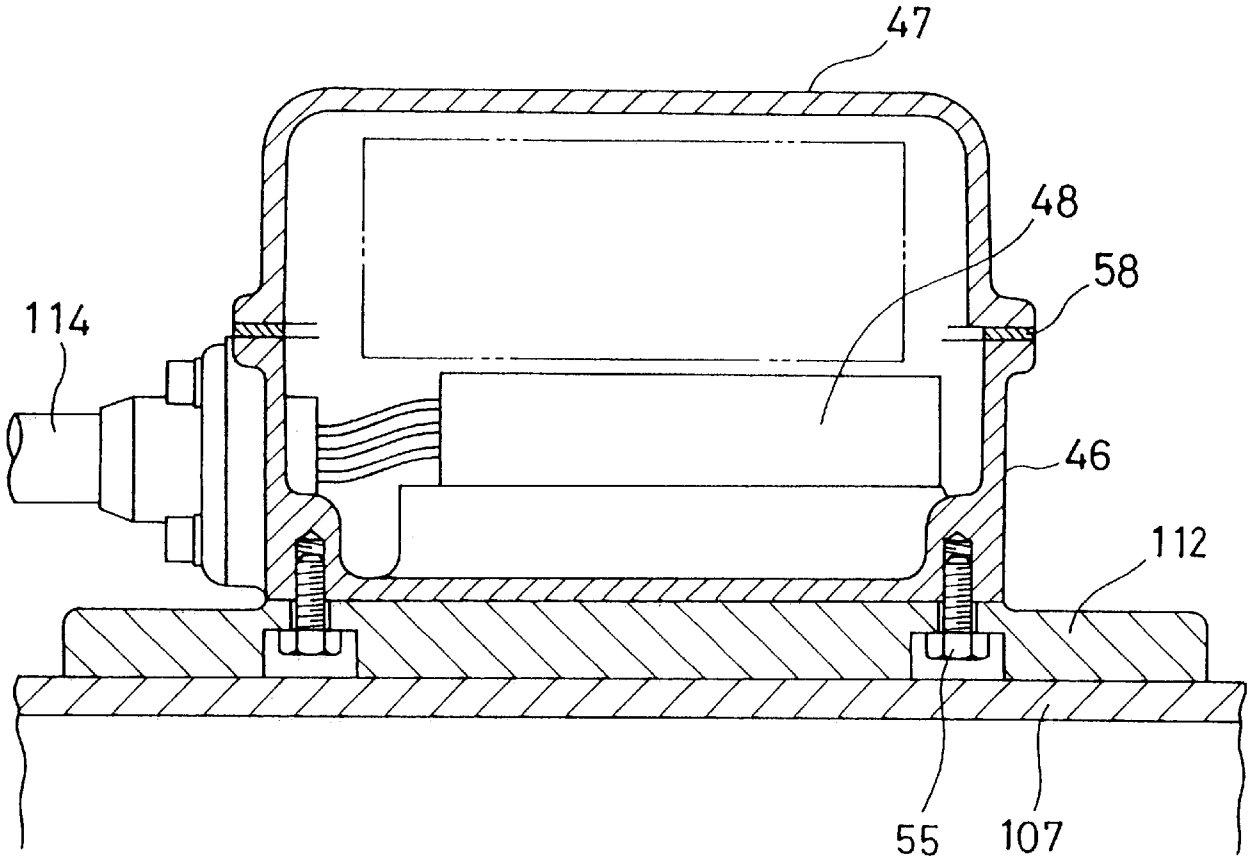
FIG. 4 is a cross sectional view taken along line IV—IV as shown in FIG. 3A.

A structure around the regulating device 111 will be described below with reference to FIG. 4 which is a cross-sectional view taken along line IV—IV of FIG. 3A. The frequency converter 48 is housed in a case which comprises the base 46 and the cover 47. The base 46 and the cover 47 made of aluminium alloy having good thermal conductivity are fixed to each other by bolts with a seal member 58 interposed therebetween for hermetically sealing from the ambient air. As shown in FIG. 4, the input cable 114 is connected to the base 46, and as shown in FIG. 3A, the output cable 115 is also connected to the heat radiating means 112.

The frequency converter 48 is highly intimately fixed to the base 46 to transfer the generated heat to the base 46. Similarly, the base 46 and the heat radiating means 112, and the heat radiating means 112 and the short pipe 107 are highly intimately fixed to each other. Since the heat generated by the frequency converter is suitably radiated into the handled fluid, the regulating device does not require an air-cooling fan for use in general inverters. Thus, the regulating device is free from insufficient cooling due to a fan failure. The base 46 and the heat radiating means 112 are fastened to each other by bolts 55. Because the interior of the case is isolated from the ambient air, the frequency converter is prevented from insulation deterioration due to weathering and water condensation.

Figure 5A:
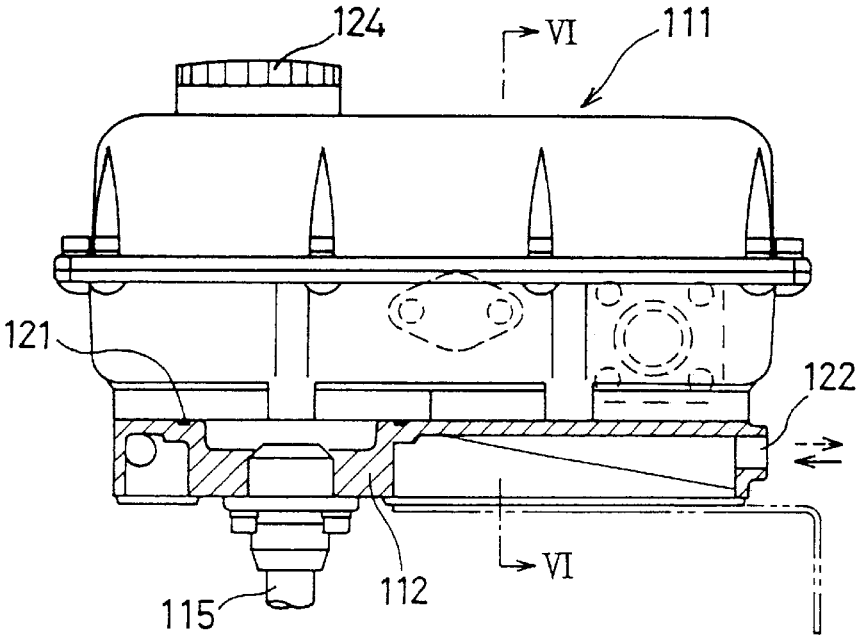
FIG. 5A is a detailed elevational view in partly cross section of the arrangement as shown in FIG. 2.
Figure 5B:
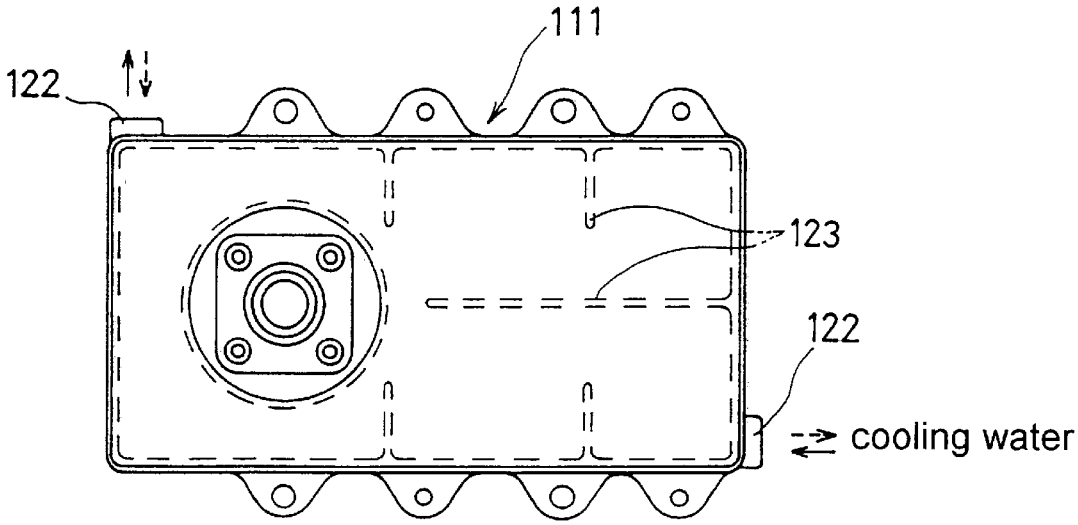
FIG. 5B is a detailed plan view of the arrangement as shown in FIG. 2.

FIGS. 5A and 5B are illustrations showing the arrangement shown in FIG. 2 in detail. FIG. 5A is a partly cross sectional elevational view, and FIG. 5B is a plan view. The heat radiating means 112 comprises of a water cooling jacket of stainless steel. The jacket is provided with an outlet or inlet port 122 for passing the fluid to be handled. The structure of the input cable, the output cable, and the O-ring 121 are the same structure as shown in FIG. 3A.

Figure 6:
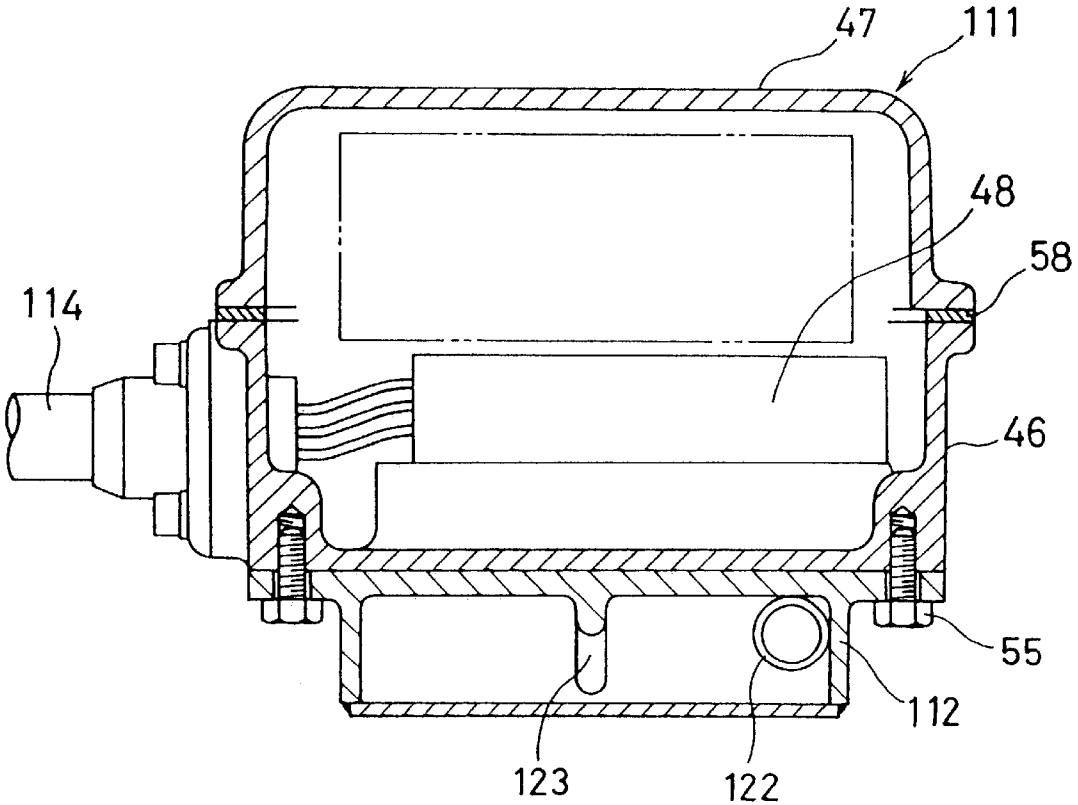
FIG. 6 is a cross sectional view taken along line VI—VI as shown in FIG. 5A.

The peripheral structure of the regulating device 111 of this embodiment will now be described with reference to FIG. 6 which is a cross sectional view taken along line VI—VI as shown in FIG. 5A. The frequency converter 48 is accommodated within a casing formed by a base 46 and a cover 47. The base 46 is secured to the cover 47 by bolts (not shown) with interposing a sealing member 58 for preventing the ingress of an ambient air.

The frequency converter 48 itself is secured tightly on the base 46 to transfer the generated heat thereto. The base 46 is also secured tightly on the heat radiating means 112. Thus, the heat generated by the frequency converter is radiated well into the fluid to be handled, so that a cooling system such as an air cooling fan used in the general purpose inverter device is not required.

The ribs 123 have three functions. The one of the functions is to increase the strength and the rigidity of the water cooling jacket to prevent deformation thereof. The other function is to guide the flow of the fluid through the jacket to assure the residence time of the fluid to be handled. Further function of the ribs is to increase the contacting area between the ribs and the fluid to be handled to enhance the effect of heat radiation. In accordance with the arrangement of this embodiment, the cooling operation can easily and effectively be carried out in spite of existence of the thermal insulation provided around pipes.

Figure 7A:
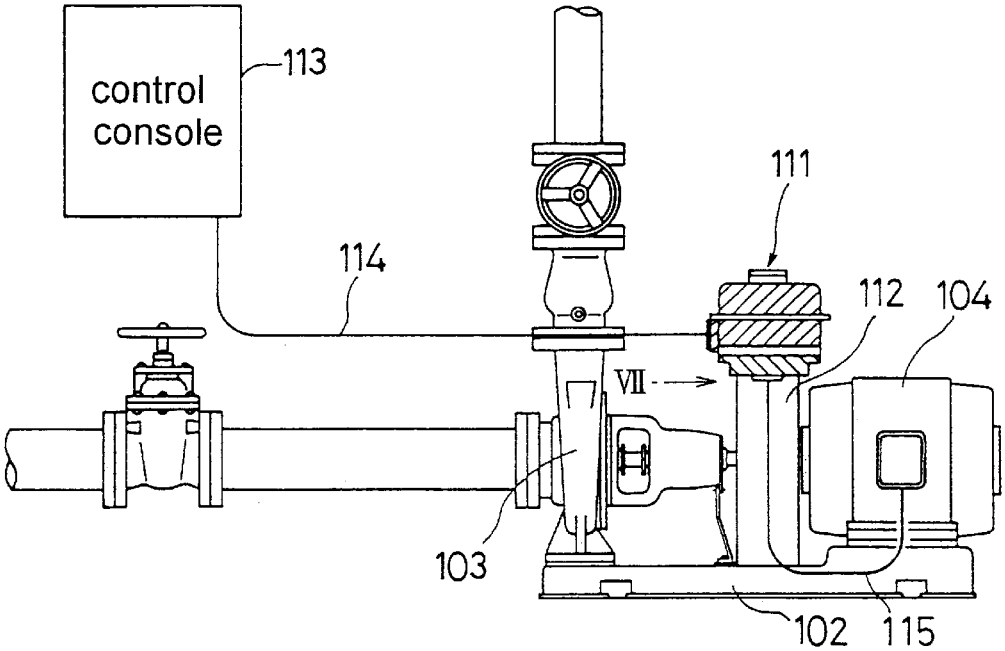
FIGS. 7A and 7B are views of the arrangement of the third embodiment in which the performance regulating device for fluid machinery of the present invention is employed.
Figure 7B:
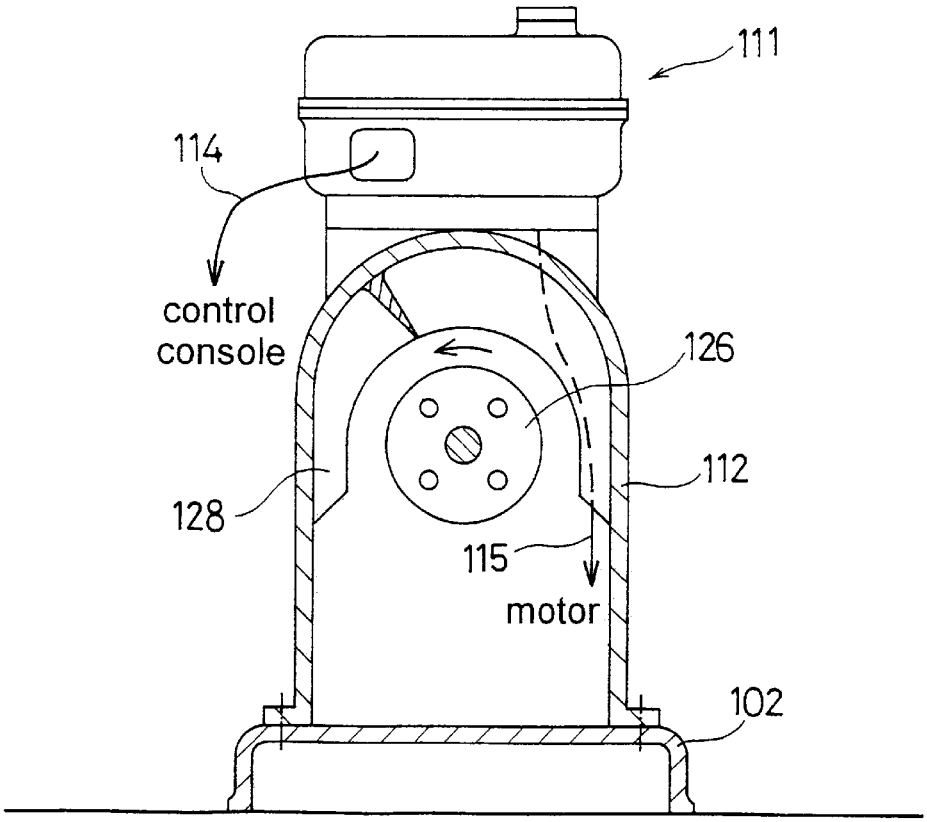

The third embodiment of the regulating device, which is mounted on a fluid machinery in accordance with the present invention will be described with reference to FIGS. 7A and 7B. FIG. 7A is a side view showing the whole construction of the fluid machinery, and FIG. 7B is an elevational view seen from the direction of the arrow VII. The basic arrangement of the third embodiment is substantially identical with those of the first and second embodiments. However, in the third embodiment, there is provided an air cooled regulating device 111, which uses air stream generated by the coupling 126 connecting the pump 103 and the motor 104.

Generally, a coupling guard for preventing an accident is provided around the coupling 126 as shown in FIG. 7B. The coupling guard is employed in this embodiment as the heat radiating means 112.

In this embodiment, the coupling guard (the heat radiating means) 112 is made of aluminium alloy, and a plurality of air cooling ribs (fins) 128 are provided therewith for enhancing the effect of cooling by the air stream. The peripheral structure of the casing is substantially identical with those of the first and the second embodiments, so that it is endurable in its weathering conditions.

Figure 8A:
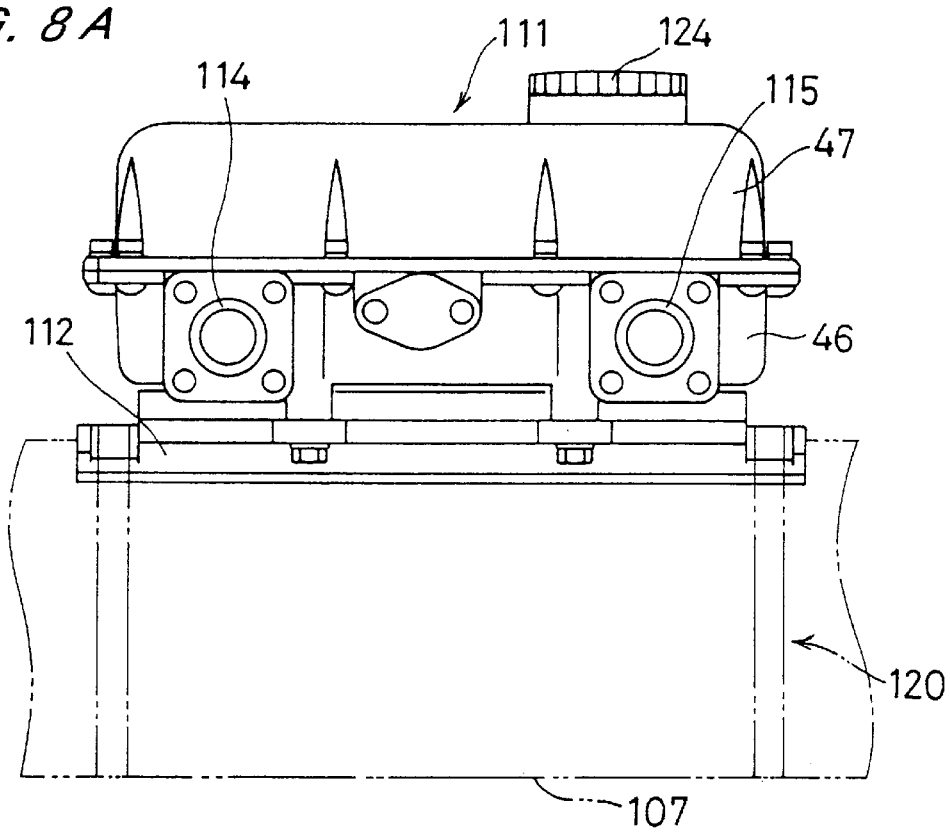
FIGS. 8A and 8B show another embodiment of the device as shown in FIGS. 1–7B.
Figure 8B:
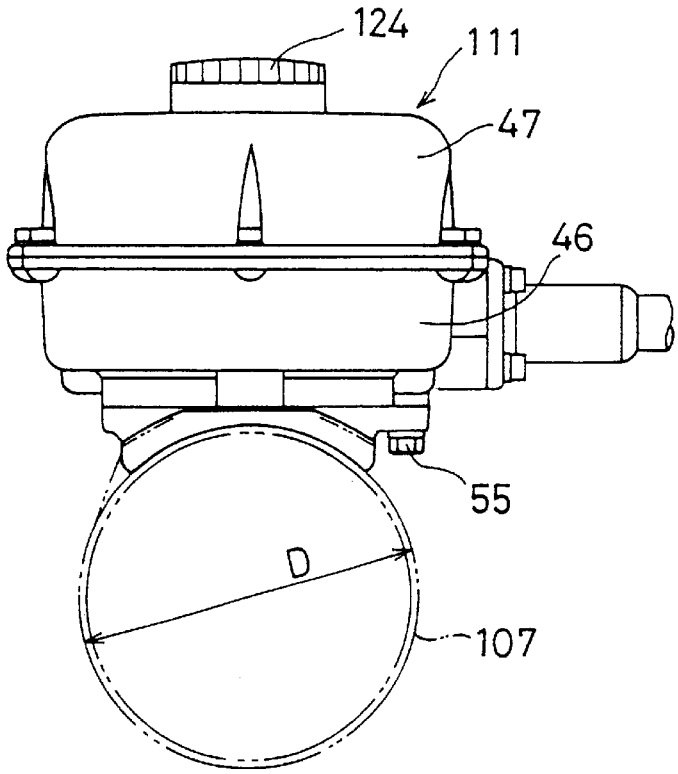

Another embodiment of the regulating device will now be described with reference to FIGS. 8A and 8B. FIG. 8A is an elevational view, and FIG. 8B is a side view. To explain briefly, the only difference from those shown in FIGS. 1–7A is that the output cable 115 is connected to the base 46.

In this arrangement, the regulating device of relatively simple structure can be provided, since it is unnecessary to connect the output cable to the heat radiating means. Of course, the arrangement can be adopted in the arrangement of the water jacket type or the air cooled type.

In FIGS. 3A and 3B, 5A and 5B, and 8A and 8B, a threaded cap 124 serves to keep the regulating device hermetically sealed from the ambient air through an O-ring (not shown). The threaded cap 124 houses therein adjusting means for output frequency. For example, the adjusting means comprises a rotary step switch for enabling to adjust the rotational speed of the fluid machinery.

Further, as can be seen in the drawings that there is no designation of an on-off switch for outputting or stopping the output of the frequency converter, the frequency converter has no means corresponding to the on-off switch. The frequency converter is arranged to commence its operation to output electric power automatically, when power supply is delivered thereto. In this connection, there is no limitation upon the position, when the regulating device is installed on the pipe line. In other words, since start and stop of the fluid machinery can merely be effected by starting or stopping the electric power supply thereto, the regulating device can be mounted on any place, for example, at a high place where children can not reach with taking into consideration of children's brogue or at a narrow space.

Figure 9:
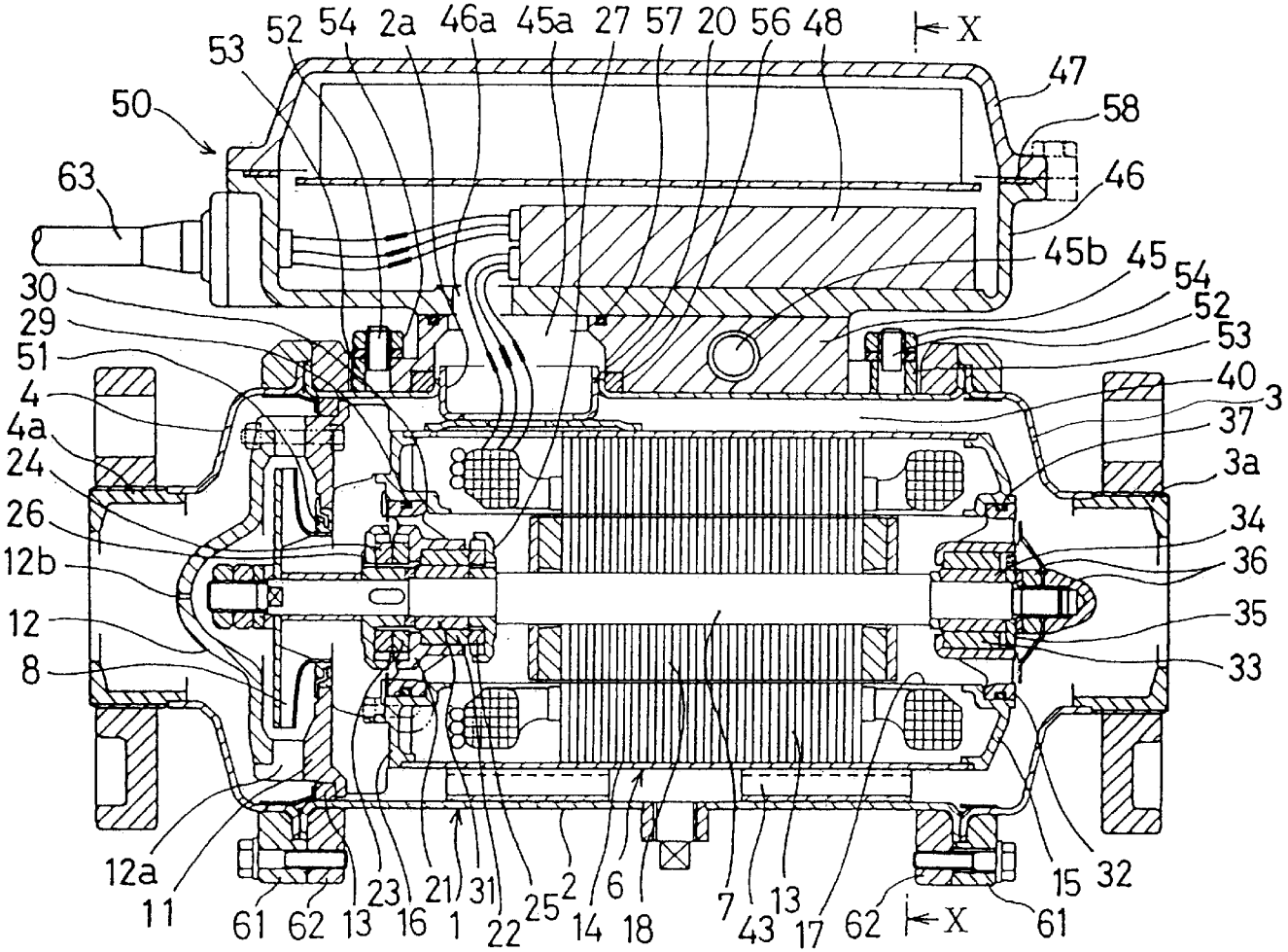
FIG. 9 is a cross sectional view showing an inline pump of a full-circumferential-flow type pump to which the frequency converter assembly is incorporated. The incorporated assembly includes elements in common with those of the performance regulating device for fluid machinery of the present invention.
Figure 10:
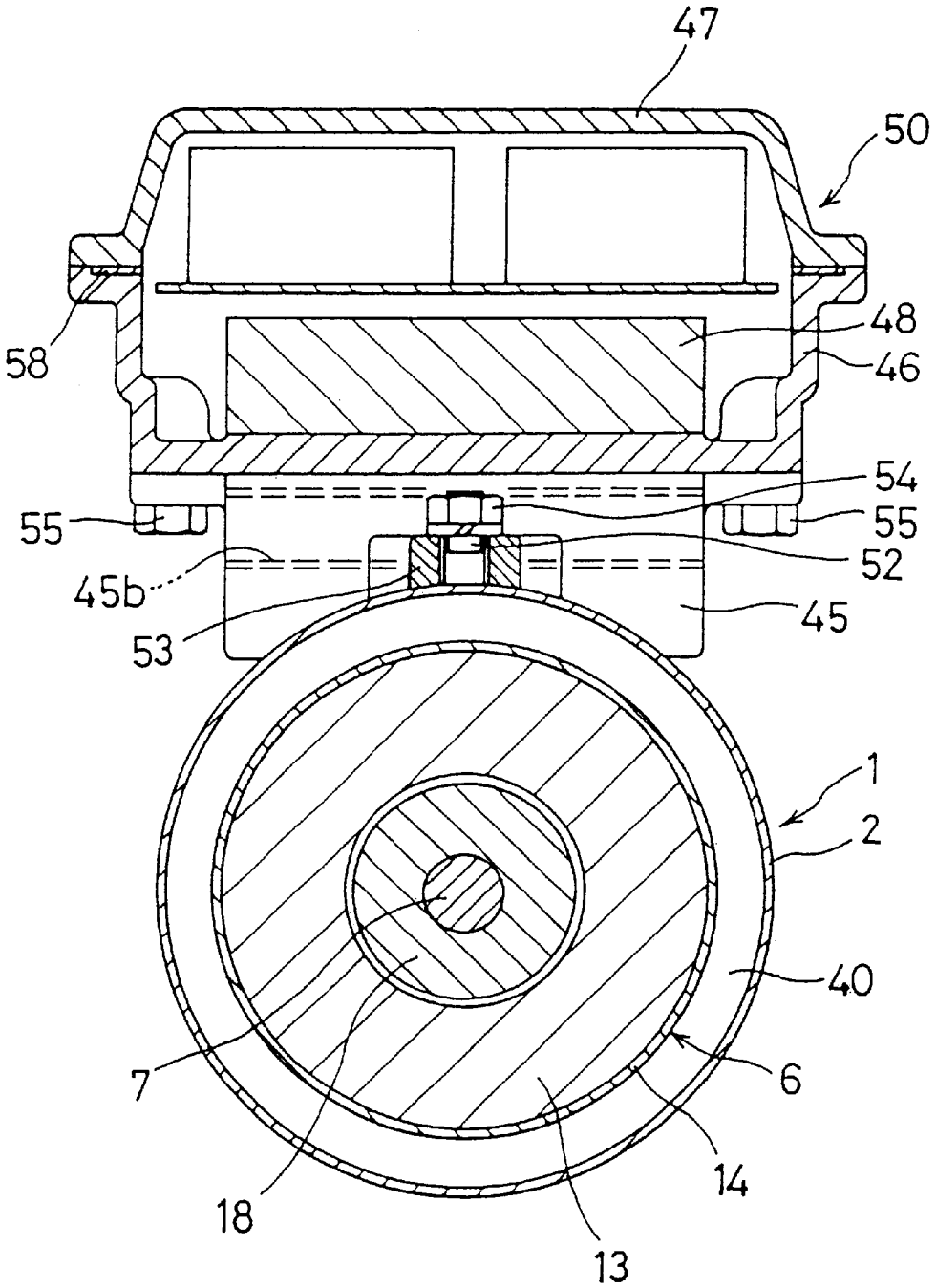
FIG. 10 is a cross sectional view taken along line X—X as shown in FIG. 9.
Figure 11:
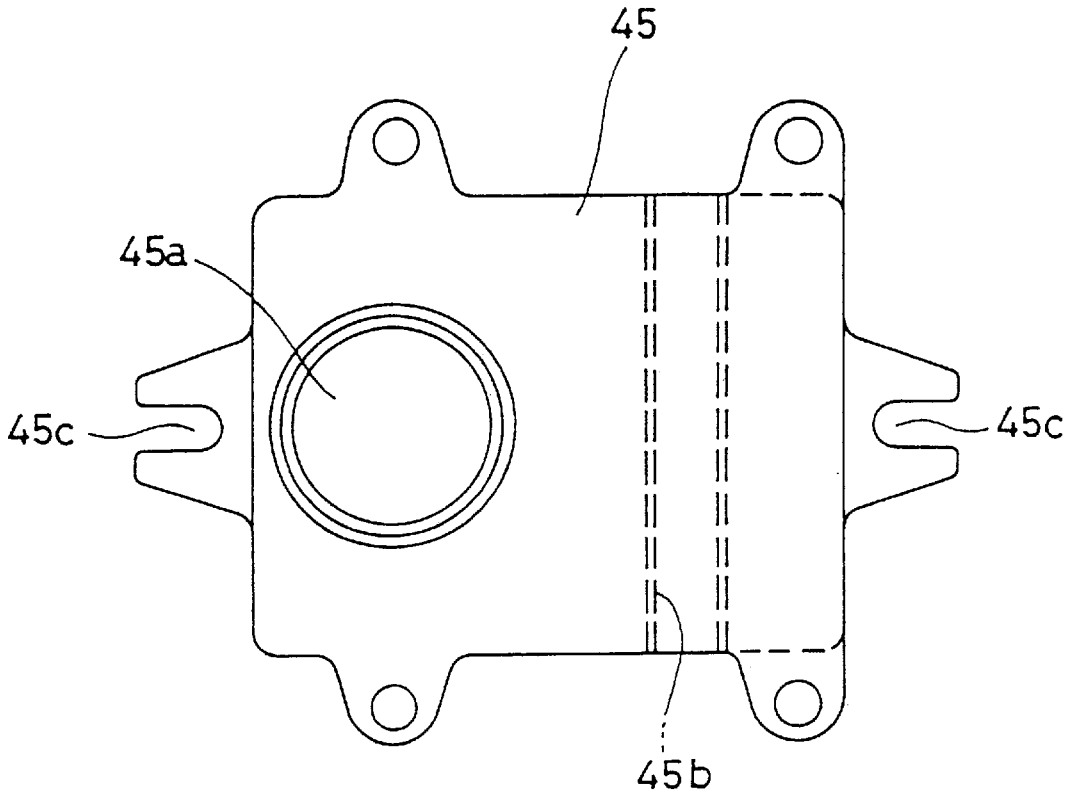
FIG. 11 is a plan view showing a bracket.

With reference to FIGS. 9–11, an embodiment of a pump having a regulating device of the present invention is described, where frequency converter is mounted integrally therewith and is used at least as common use.

Before describing the embodiment of the FIGS. 9–11, the advantages of the converter itself as the common use will be described briefly. By the mass production, reduction of the cost can be obtained by providing new pumps incorporating inverter device as shown in FIGS. 9–11 to the newly constructed pump facilities, and providing flow regulating devices to the existing pump facilities, which are not yet to the limit of its service life. Accordingly, energy saving devices can be easily accepted in the market. FIG. 9 is a cross sectional view, which illustrates an inline full-circumferential-flow type pump. The illustrated pump has a frequency converter assembly mounted integrally therewith, which are in common use with those of the performance regulating device for an existing fluid machinery in accordance with the present invention. FIG. 10 is a cross sectional view taken along line X—X as shown in FIG. 9.

A full-circumferential-flow pump of this embodiment comprises a pump casing 1, a canned motor 6 housed in the pump casing 1, and an impeller 8 fixedly mounted on a main shaft 7 of the canned motor 6. The pump casing 1 comprises an outer cylinder 2, a suction-side casing 3 connected to an axial end of the outer cylinder 2 by flanges 61, 62, and a discharge-side casing 4 connected to an opposite axial end of the outer cylinder 2 by flanges 61, 62. The flanges 61 and 62 constitute fixing means for fixing another member such as the suction-side casing 3 or the discharge-side casing 4 to the outer cylinder 2. Each of the outer cylinder 2, the suction-side casing 3, and the discharge-side casing 4 is made of a pressed sheet of stainless steel or the like.

A bracket 45 is attached to the outer surface of the outer cylinder 2. A regulating device 50 is mounted on the bracket 45. The regulating device 50 comprises a base 46 attached to the bracket 45, a cover 47 attached to the base 46, and a frequency converter 48 housed in the base 46 and the cover 47.

The bracket 45 has a through hole 45*a* for allowing leads for connecting the canned motor 6 and the frequency converter 48 to pass therethrough. The bracket 45, the base 46 and the cover 47 are composed of thermally good conductor such as aluminum alloy. The bracket 45 has a through hole 45*b* for allowing cooling water for cooling the frequency converter 48 to pass therethrough.

The canned motor 6 comprises a stator 13, an outer motor frame barrel 14 fixedly fitted over the stator 13, a pair of motor frame side plates 15, 16 welded to respective opposite open ends of the outer motor frame barrel 14, and a can 17 fitted in the stator 13 and welded to the motor frame side plates 15, 16. The canned motor 6 also has a rotor 18 rotatably disposed in the stator 13 and shrink-fitted over the main shaft 7. An annular fluid passage 40 is formed between the outer motor frame barrel 14 and the outer cylinder 2.

Further, a guide device 11 for guiding fluid from a radially outer direction toward a radially inner direction is held by the motor frame side plate 16. An inner casing 12 for housing an impeller 8 therein is fixed to the guide device 11. A sealing member 13 is provided on the outer periphery of the guide device 11.

A liner ring 51 is mounted on a radially inner end of the guide device 11 and is in slide contact with the forward end (suction mouth) of the impeller 8. The inner casing 12 has a dome-like shape so that it covers the end of the main shaft 7 of the canned motor 6. The inner casing 12 has a guide device 12*a* comprising a guide vane or a volute for guiding fluid discharged from the impeller 8. The inner casing 12 has a vent hole 12*b* at the forward end thereof.

A cable housing 20 is welded to the outer motor frame barrel 14. Leads from coils disposed in the outer motor frame barrel 14 are extended through the cable housing 20, the through hole 45*a* of the bracket 45 and a lead hole 46*a* of the base 46, and connected to the frequency converter 48 in the base 46 and the cover 47. Further, a cable 63 is introduced into the base 46 and connected to leads of the frequency converter 48 in the base 46 and the cover 47. The outer cylinder 2 has a hole 2*a* into which the cable housing 20 is inserted.

Next, a bearing assembly at the impeller side will be described. A radial bearing 22 and a stationary thrust bearing 23 are mounted on a bearing bracket 21. The radial bearing 22 has an end which serves as a stationary thrust sliding member. A rotary thrust bearing 24 and a rotary thrust bearing 25 each serving as a rotary thrust sliding member are disposed one on each side of the radial bearing 22 and the stationary thrust bearing 23. The rotary thrust bearing 24 is secured to a thrust disk 26 which is fixed to the main shaft 7 through a key. The rotary shaft bearing 25 is secured to a thrust disk 27 which is fixed to the main shaft 7 through a key.

The bearing bracket 21 is inserted in a socket defined in the motor frame side plate 16 through a resilient O-ring 29. The bearing bracket 21 is also held against the motor frame side plate 16 through a resilient gasket 30. The radial bearing 22 slidably supports a sleeve 31 which is fitted over the main shaft 7.

Next, a bearing assembly at the opposite side of the impeller will be described. A radial bearing 33 is mounted on a bearing bracket 32, and slidably supports a sleeve 34 which is fitted over the main shaft 7. The sleeve 34 is axially held against a washer 35 which is fixed to the main shaft 7 by a double nut 36 threaded over an externally threaded surface on an end of the main shaft 7. The bearing bracket 32 is inserted in a socket defined in the motor frame side plate 15 through a resilient O-ring 37. The bearing bracket 32 is also held against the motor frame side plate 15. Stays 43 are welded to the outer motor frame barrel 14, and the stays 43 and the outer cylinder 2 are welded together. The rotational speed of the canned motor is set to 4,000 rpm or more by the frequency converter 48.

Operation of the full-circumferential-flow pump shown in FIG. 9 will be described below.

A fluid drown into the suction-side casing 3 from the suction nozzle 3*a* flows into the annular fluid passage 40 defined between the outer cylinder 2 and the outer motor frame barrel 14 through the suction-side casing 3. Then, the fluid is introduced into the impeller 8 through the annular fluid passage 40 and the guide device 11. The fluid discharged from impeller 8 is discharged through the guide device 12*a* from the discharge nozzle 4*a* which is connected to the discharge-side casing 4.

According to this embodiment, the bracket 45 is provided between the regulating device 50 and the outer cylinder 2 of the pump casing 1. The bracket 45 serves as a dimension adjustment member, and is dimensioned such that it is smaller than the base 46 of the regulating device 50. The bracket 45 is a small component, and hence the preparation of many kinds of brackets does not lead to a lowering of productivity.

As shown in FIG. 9, two fixing members 53 having respective bolts fixed thereto are fixed at a certain interval to the outer cylinder 2 by welding. On the outer hand, as shown in FIG. 11, the bracket 45 has notches 45*c* at its both ends. The bracket 45 is fixed to the outer cylinder 2 in such a manner that the notches 45*c* of the bracket 45 are fitted with the fixing members 53, respectively, and then nuts 54 are fastened to the bolts 52, respectively.

Next, the method for fixing the regulating device 50 to the motor pump will be described.

First, the regulating device 50 is independently assembled by housing the frequency converter 48 in the base 46 and the cover 47. After the regulating device 50 is assembled, the regulating device 50 and the bracket 45 are fixed to each other. This is preformed by fastening the bolts 55 to the base 46 through the bracket 45. This work can be made from the outside of the regulating device 50. After the bracket 45 and the regulating device 50 are fixed to each other, the notches 45*c* of the bracket 45 are fitted with the fixing members 53, respectively, and the nuts 54 are fastened to the bolts, respectively, whereby the bracket 45 is fixed to the outer cylinder 2 of the motor pump.

In this manner, the regulating device 50 comprises the base 46 attached to the bracket 45, the cover 47 attached to the base 46, and the frequency converter 48 housed in the base 46 and the cover 47. Therefore, the regulating device 50 can be independently assembled. The fixing of the bracket 45 and the regulating device 50 to each other can be carried out from the outside of the regulating device 50. Further, after the bracket 45 and the regulating device 50 are fixed to each other, the bracket 45 can be fixed to the outer cylinder 2. The cover 47 and the base 46 are unnecessary to be disassembled from each other normally, except for maintenance of the frequency converter 48. That is, when the frequency converter is mounted on the pump or removed from the pump, the highly integrated circuit of the frequency converter is not exposed to the outside. This structure is effective because the highly integrated circuit or the electrical board is weak in dust or dirt.

According to this embodiment, the bracket 45 has the through hole 45*a* to connect the canned motor 6 and the frequency converter 48 electrically. Thus, attachment of the regulating device 50 to the motor pump can be made with ease.

According to this embodiment, the bracket 45, the base 46 and the cover 47 are composed of thermally good conductor, i.e., aluminum alloy. Since the frequency converter of this kind is mainly cooled by a liquid handled by the pump, aluminum alloy is preferable. The above members are made of metal to thus shield radiation noise from the frequency converter. Especially, the bracket is made of metal to thus shield harmonic noise generated in the secondary side of the frequency converter.

Further, according to this embodiment, the bracket 45 has the through hole 45*b* for allowing cooling water to pass therethrough. The frequency converter is normally cooled by a liquid handled by the pump. If the liquid handled by the pump has high temperature, the frequency converter cannot be cooled by the pumped liquid. In such a case, cooling liquid can be supplied from the outside to the though hole 45*b* of the bracket 45 to cool the frequency converter sufficiently.

According to this embodiment, heat transfer medium is interposed between the outer cylinder 2 and the bracket 45, between the bracket 45 and the base 46, and between the base 46 and the cover 47. If a clearance is formed between two members, air is in the clearance to prevent heat transfer between two members, resulting in inferior cooling. Therefore, heat transfer medium such as liquid silicon is charged into the clearance to improve heat transfer between two members.

According to this embodiment, sealing members 56, 57 and 58 are provided between the outer cylinder 2 and the bracket 45, between the bracket 45 and the base 46, and between the base 46 and the cover 47, respectively. Thus, moisture is prevented from entering the case housing the frequency converter 48, and the frequency converter is not deteriorated due to dew formed by moisture when cooled by the liquid handled by the pump.

Further, according to this embodiment, in the pump assembly comprising the outer motor frame barrel 14 provided around the stator 13 of the canned motor 6, the outer cylinder 2 defining the annular fluid passage 40 between the outer motor frame barrel 14 and the outer cylinder 2, a pump section including the impeller 8 for allowing liquid to flow in the annular fluid passage 40, and fixing means comprising the flanges 61 and 62 for fixing another member such as the suction-side casing 3 or the discharge-side casing 4 to the outer cylinder 2, the regulating device 50 is mounted on the outer circumferential portion of the outer cylinder 2, and both ends of the regulating device are axially extended beyond the fixing means 61, 62 provided at both ends of the outer cylinder 2.

Figure 12:
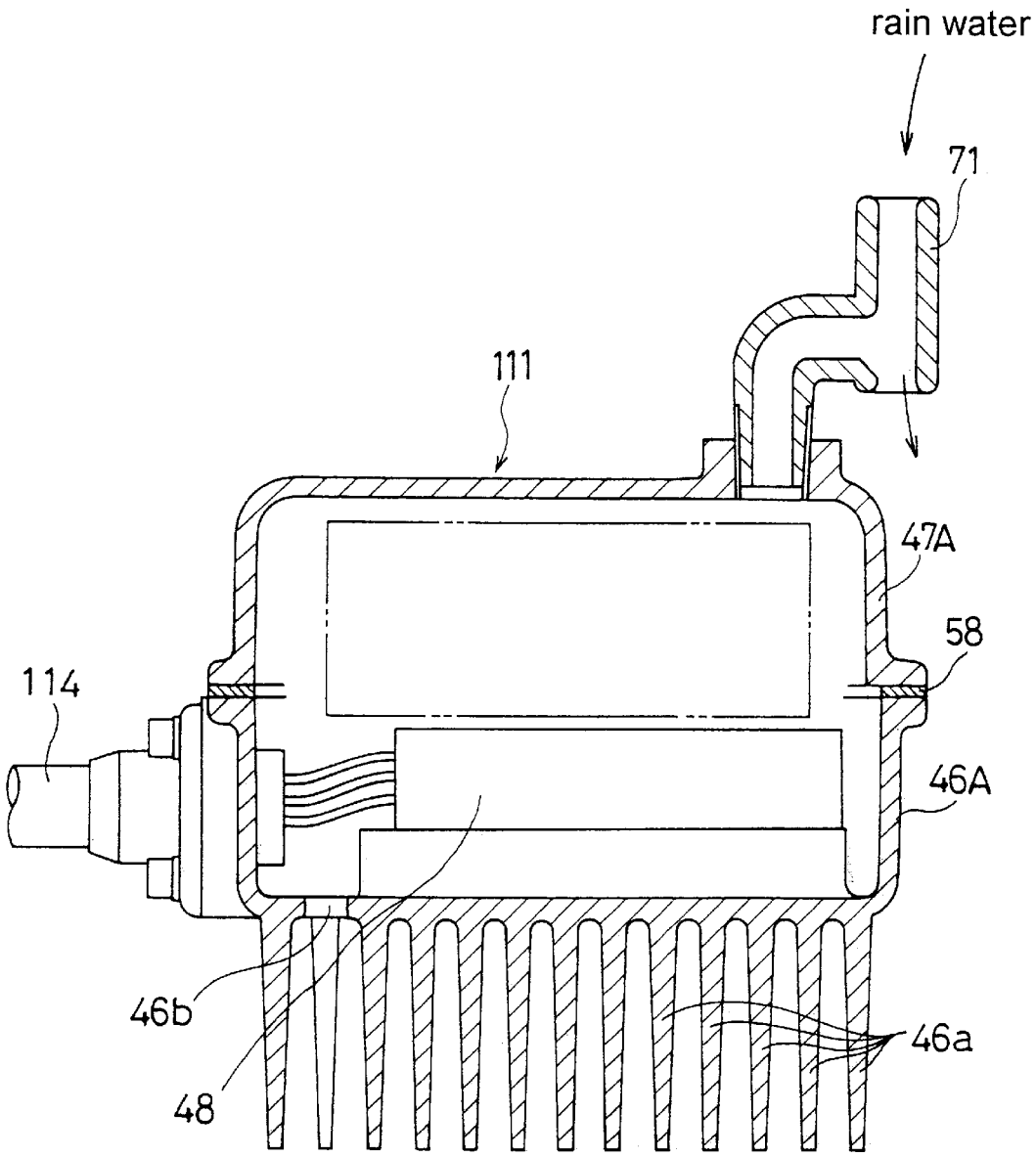
FIG. 12 is a longitudinal cross sectional view showing another embodiment of the present invention.
Figure 13A:
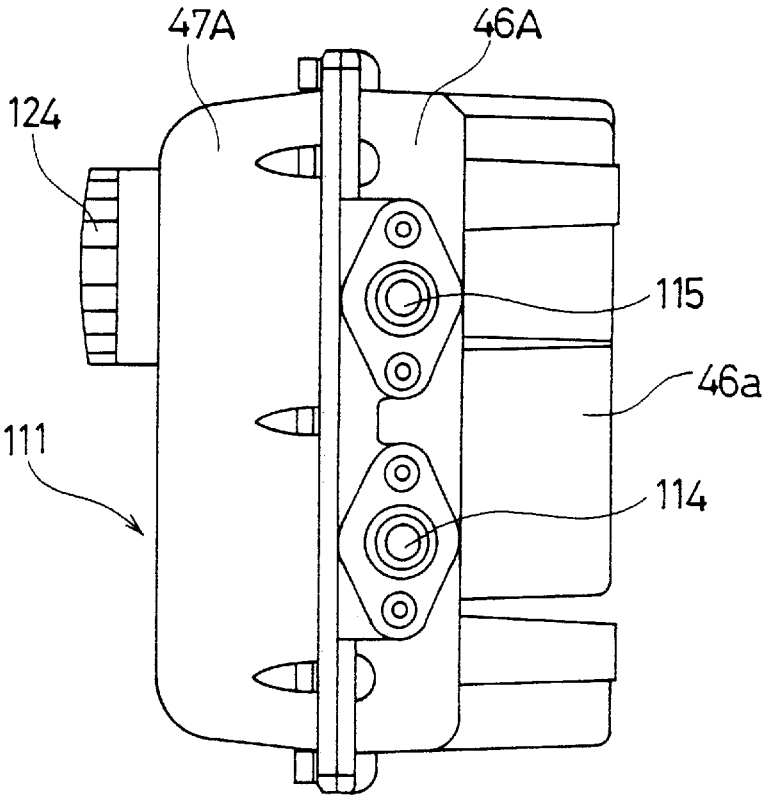
FIG. 13A is an elevational view showing the appearance of the regulating device.
Figure 13B:
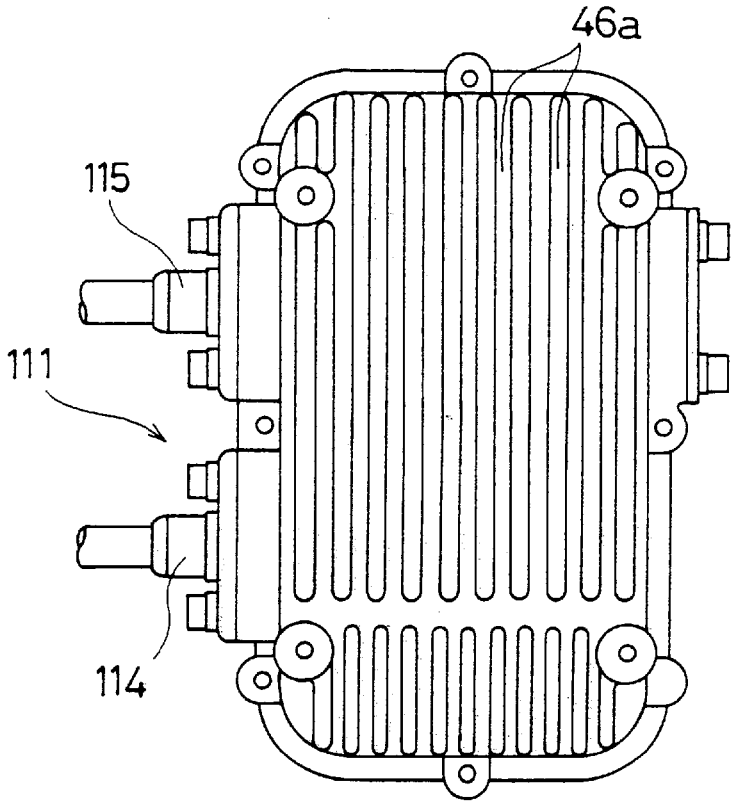
FIG. 13B is a bottom view showing the appearance of the regulating device.

Another embodiment of the regulating device 111 is illustrated in FIGS. 12, 13A, and 13B. FIG. 12 is a longitudinal cross sectional view of the regulating device 111, FIG. 13A is an elevational view showing the appearance of the regulating device 111, and FIG. 13B is a bottom view showing the appearance of the regulating device 111.

As can be seen from FIG. 12, the frequency converter 48 is accommodated within a casing formed by a base 46A and a cover 47A. The base 46A and the cover 47A are made of aluminium alloy having good thermal conductivity, and secured by bolts (not shown) with interposing a sealing member 58 therebetween. The frequency converter 48 is secured tightly on the base 46A. The base 46A has a plurality of air cooling fins 46*a* on the bottom portion thereof. The fins 46*a* are provided for emitting the heat generated by the conversion loss of the frequency converter to the atmosphere. The lower surface of the base 46A is also provided with a hole 46*b* for introducing air into the casing.

The upper surface of the cover 47A is provided with a ventilation duct 71 as shown in FIG. 12. The ventilation duct 71 does not allow the ingress of rain water into the casing mostly, but facilitates the ventilation of the air freely.

In the arrangement of this embodiment, the heat generated by the frequency converter (inverter device):

(1) can be radiated by the emission of the heat through the air cooling fins 46*a;* and (2) can be effectively radiated by exchanging the warm or hot air within the casing directly with the air of atmosphere.

Namely, since the temperature of the air within the casing is increased by the generated heat, the specific gravity of the air is reduced thereby, and the air of thus reduced in its density is tend to be ascended to the ceiling formed by the cover, and then discharged out through the ventilation duct 71. Then, the discharged air within the casing is refilled by fresh air, which is suctioned through the hole 46*b* of the base 46A. Thus, the heat generated by the inverter device can be bleed out efficiently into the atmosphere.

The configuration and the position of the ventilation duct 71 and the hole 46*b* for introducing air into the casing can be selected appropriately so as to meet with attaching manner and direction of counterpart member thereof, with which the regulating device 111 is mounted.

In case the rain water is penetrated through the ventilation duct 71, or the dew is produced within the casing in any reason, the water within the casing may be delivered out through the hole 46*b* provided through the base 46A. In this reason, the arrangement can be used in almost all sites without causing any problem.

Provided that the sufficient cooling effect can be obtained, the casing may be hermetically sealed. In such a structure, no water can be penetrated into the casing, even if any direction or any amount of rain falls.

When a submerged cable is employed as input means or output means of the power supply, the performance regulating device can be disposed under water. This arrangement is preferable when the performance of the submerged motor pump is controlled under water, and also preferable for cooling the frequency converter.

As can be seen in FIGS. 12, 13A, and 13B, the base 46A is provided with an input cable 114 and an output cable 115 being fixed therewith.

Figure 14:
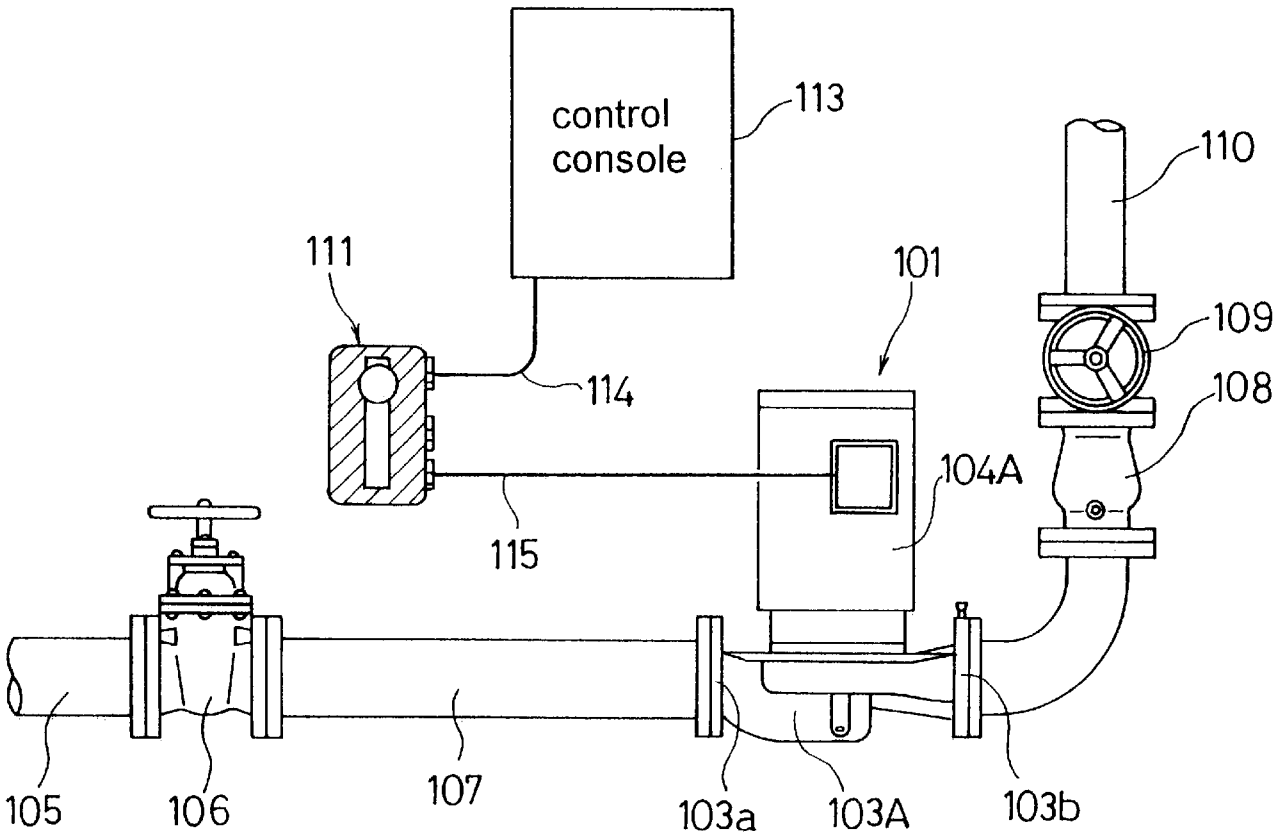
FIG. 14 is a diagrammatic illustration showing the regulating device as illustrated in FIGS. 12, 13A, and 13B, which is installed in a pumping facility.

The regulating device as illustrated in FIGS. 12, 13A, and 13B is installed for use as shown in FIG. 14. The pump unit is designated by the reference numeral 101, and includes an inline pump 103A and a motor 104A. The fluid introduced through a suction pipe 105 flows through a gate valve 106 provided on a suction side and a short pipe 107, and via an inlet port 103*a* of the pump into the pump 103A, and increased in its pressure by the pump, and then discharged from an outlet port 103*b* of the pump. The discharged fluid is then introduced into a delivery pipe 110 through an check valve 108 and a gate valve 109 provided on a discharge side.

The electric power supplied from a control console 113 is input through an input cable 114 into the frequency converter accommodated within the regulating device 111, and the frequency conversion is carried out. The cable 114 is connected as input means of the regulating device 111. The electric power of thus converted in its frequency is supplied through an output cable 115 into the motor 104A. The cable 115 is connected as output means of the regulating device 111. The frequency conversion carried out in the regulating device 111 will inevitably generate a heat loss. However, generated heat loss is in this embodiment emitted through air cooling fins 46*a,* and through exchanging of the warm or hot air within the casing (including the base 46A and the cover 47A) with air of atmosphere directly. Thus the frequency converter can be cooled efficiently.

An embodiment in which a casing housing the frequency converter is attached on the counterpart member by member of straps or strings will be described with reference to FIGS. 15A–17B.

In the case that the fluid machinery is a submerged pump, it is preferable to mount the regulating device 111 on a pipe to be connected to the pump. This is, because a pipe (there is a case of hose) is inevitably connected with the submerged pump, convenient for obtaining a space for mounting the regulating device 111 thereon.

Figure 15A:
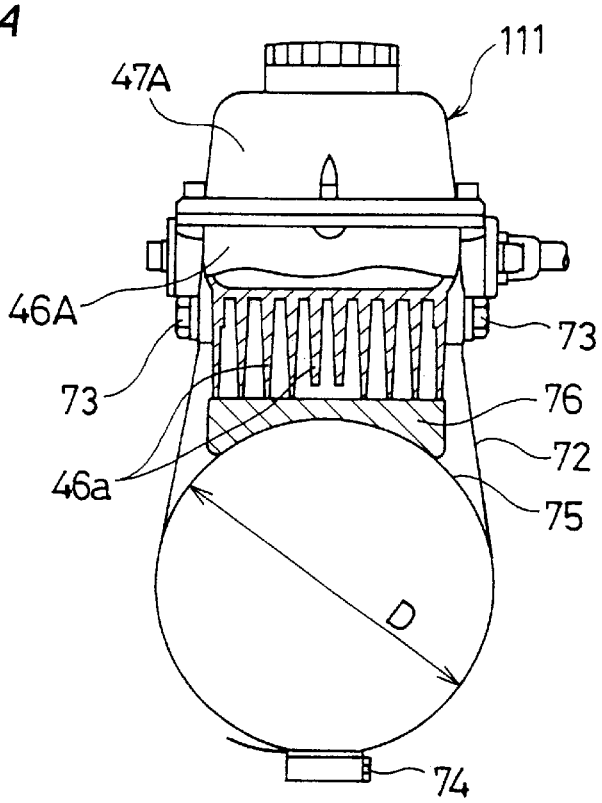
FIGS. 15A and 15B are views of the arrangement of the embodiment in which the performance regulating device of naturally air cooling type is attached on a pipe.
Figure 15B:
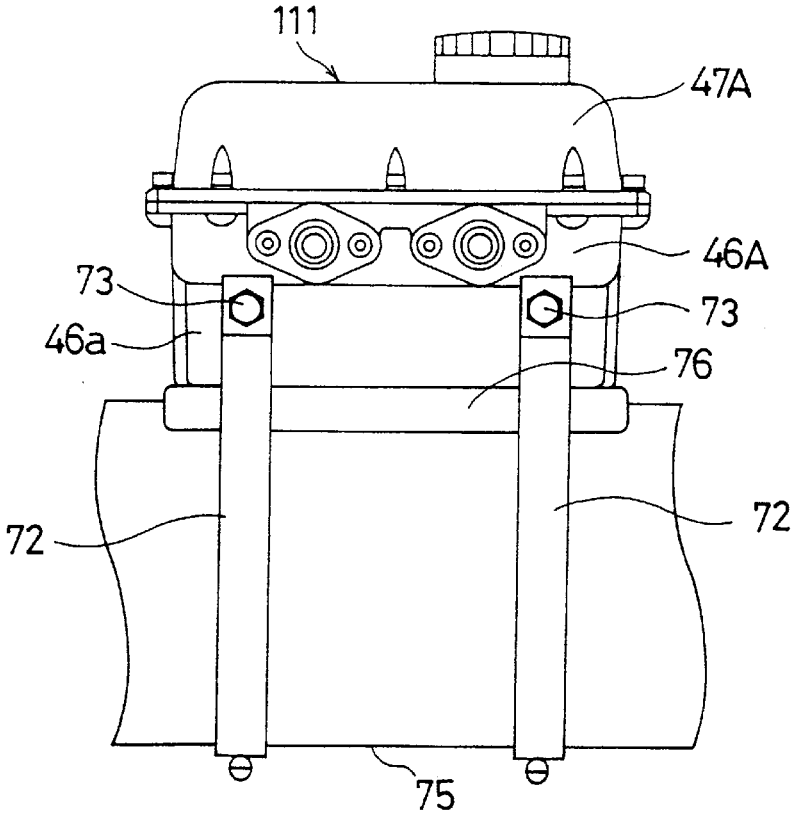

A regulating device of naturally air-cooling type is shown in FIGS. 15A and 15B, which is mounted on a pipe. FIG. 15A is a front elevational view, partly in cross section, and FIG. 15B is a side view. In the case of naturally air-cooling type, the counterpart member on which the regulating device 111 is to be mounted is not necessarily limited to the pipe, but a tree or a pole, for example, can be used as the counterpart member.

In this embodiment, fastening bands 72 (e.g. those of sheet metal of stainless steel) are fixed to the casing by bolts 73, and the bands are tightened on the pipe 75 of the diameter of D by tightening screw 74 as shown in FIG. 15A. When a cushioning material 76 formed such as of rubber or sponge is interposed between the casing and the pipe 75, the cushioning material will improve the stability thereof upon mounting.

In such method employing the straps, wires, or strings to mount the casing on the counterpart member, the cumbersome operation for altering the already constructed pipe line is not necessary, thus the mounting operation of the regulating device can be carried out easily.

Figure 16A:
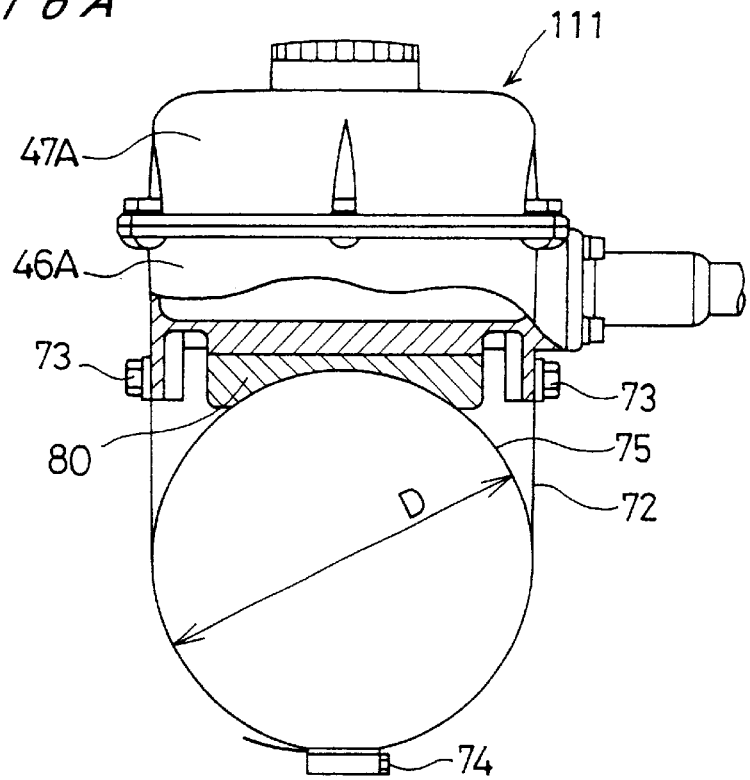
FIGS. 16A and 16B are views of the arrangement of the embodiment in which the performance regulating device of water cooling type is attached on a pipe.
Figure 16B:
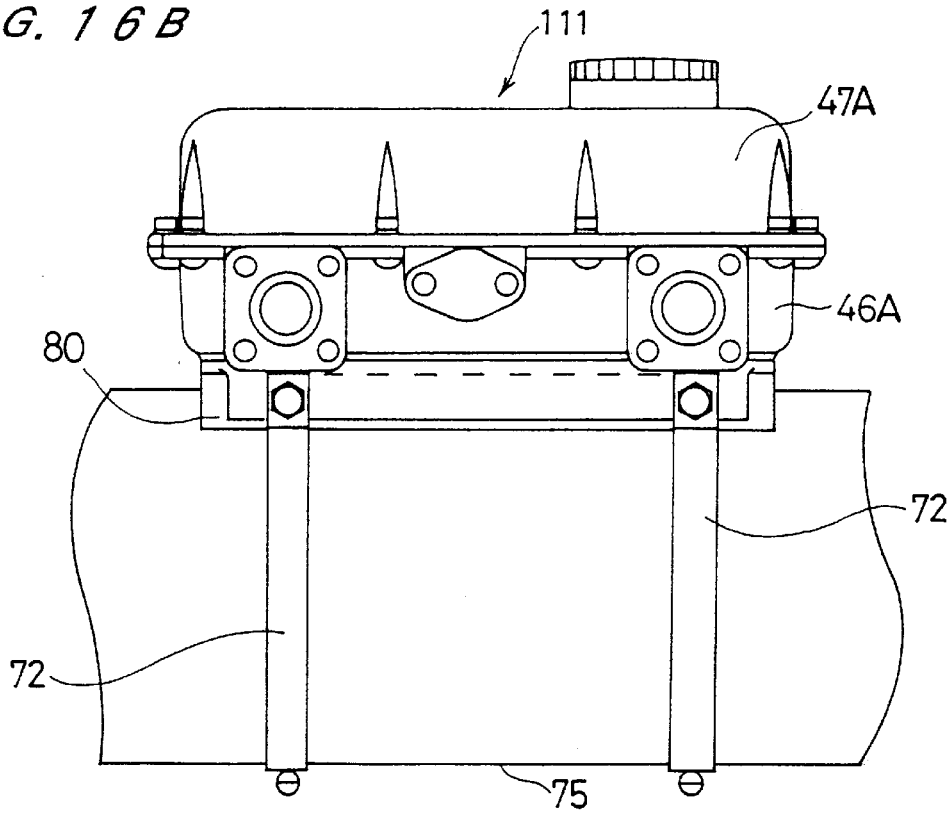

A regulating device 111 of water-cooling type mounted on a pipe is shown in FIGS. 16A and 16B. FIG. 16A is a front elevational view, partly in cross section, and FIG. 16B is a side view. In the embodiment as shown in FIGS. 16A and 16B, the heat generated by the frequency converter is radiated through the surface of the pipe into the fluid to be handled by the pump. The structure of the fastening bands 72 are the same as those shown in FIGS. 15A and 15B.

The direct contact of the casing (including the base 46A and the cover 47A) with the pipe is most effective for radiating the heat. In order to contact the casing with the pipe directly, it is necessary to adjust of the shape of the base of the casing to conform to the diameter of the pipe on which the casing is to be mounted. However, preparing various sizes of performance regulating devices in corresponding with various diameters of the pipes will decrease the productivity. In order to overcome such disadvantage, a mounting bracket 80 for functioning as a size adapting member is interposed between the casing and the pipe 75 as shown in FIGS. 16A and 16B. The regulating device 111 of a fixed size (one size) can be mounted through the size adapting member on a pipe of various diameters, such as 32 mm, 40 mm, 50 mm, 65 mm, 80 mm, 100 mm, 125 mm, 150 mm, 200 mm.

The bracket 80 can be made of aluminium alloy having good thermal conductivity. In such a case, it is preferred to manufacture the bracket 80 by drawing. The longitudinal direction of the drawn bracket 80 is coincident with the longitudinal direction of the pipe within which the fluid to be handled by the motor pump flows.

The bracket 80 (size adapting member) can also be made of the resinous material to be hardened with time. In such a case, clearances formed between elements are filled by injected resin and cured therein after fastening the casing and the pipe with the fastening bands. The thermal conductivity of the resinous material may preferably be improved by blending metallic powder.

Further, the bracket can be formed of an elastic member such as rubber or a plastic member such as clay having good thermal conductivity.

It is preferred to provide an attaching member such as the band to have a spring effect. The member having spring effect can maintain the casing and the pipe being contacted tightly with each other, even if the tightening screw is loosened. It is also advantageous to form the band (string or wire) with the elastic material such as a rubber.

Figure 17A:
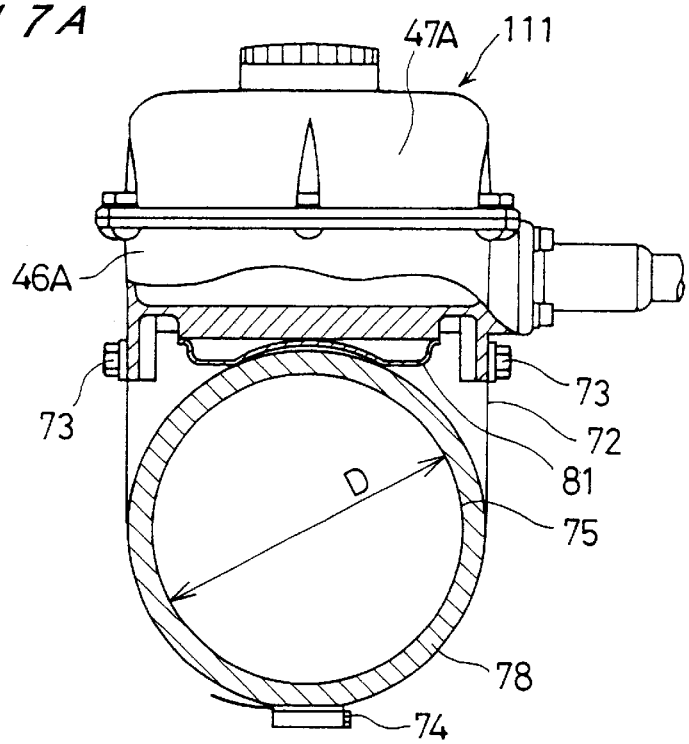
FIGS. 17A and 17B are views of the arrangement of another embodiment in which the performance regulating device of water cooling type is attached on a pipe.
Figure 17B:
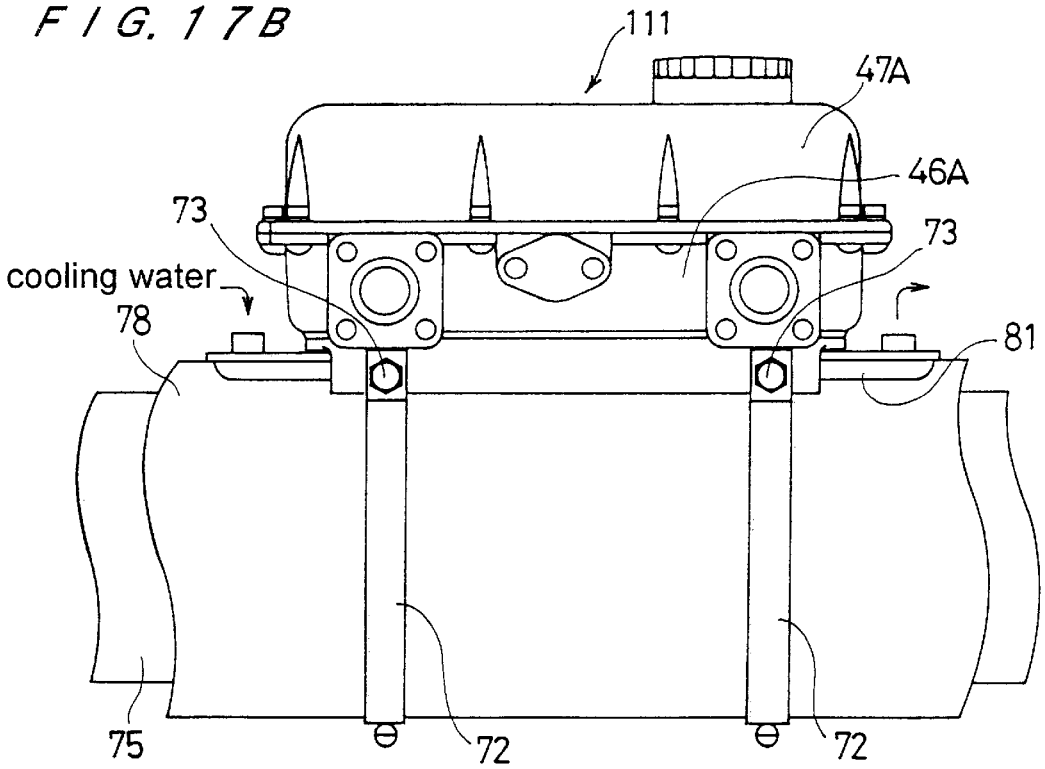

Another embodiment of a regulating device 111 of the water-cooling type mounted on a pipe is shown in FIGS. 17A and 17B. FIG. 17A is a front elevational view, partly in cross section, and FIG. 17B is a side view. The illustrated embodiment is a structure of cooling-water type, which is not applicable for direct heat radiation to the fluid within the pipe. For example, the embodiment is applied in the case that thermal insulation material such as a lagging is provided around the pipe. The structure of the fastening band is the same as that illustrated in FIGS. 15A, 15B, 16A, and 16B. A water jacket 81 is interposed between the casing (including the base 46A and the cover 47A) and the thermal insulating material 78 provided around the pipe 75, and secured thereon. The frequency converter can be cooled effectively by introducing a coolant into the water jacket 81. A portion of the fluid handled by the pump can be utilized as the coolant, while when the fluid is hot, service water can be introduced therein.

In accordance with the present invention, the same regulating device can be used with adjusting various conditions of pipes as shown in FIGS. 16A, 16B, 17A, and 17B, thus the degree of freedom of mounting is relatively high.

The weathering proof structure of the device of the present invention can be utilized not only as the performance regulating device but also as the frequency converter unit. Because, the device can be used in out-of-doors.

The casing employed for housing the frequency converter can be used in a variety of other applications. Generally, troubles may occur on electric elements due to the degradation of the insulation by the rain water or the humidity. In accordance with the present invention, such trouble can be avoided by housing electric elements within the sealed casing.

In such cases, the contents of the performance regulating device can be merely exchanged for other application, thus providing good productivity in view of utilizing common elements or parts.

In some cases, an AC reactor or noise filter is required for reducing the harmonics or for reducing line noises at the input of the frequency converter.

Figure 18:
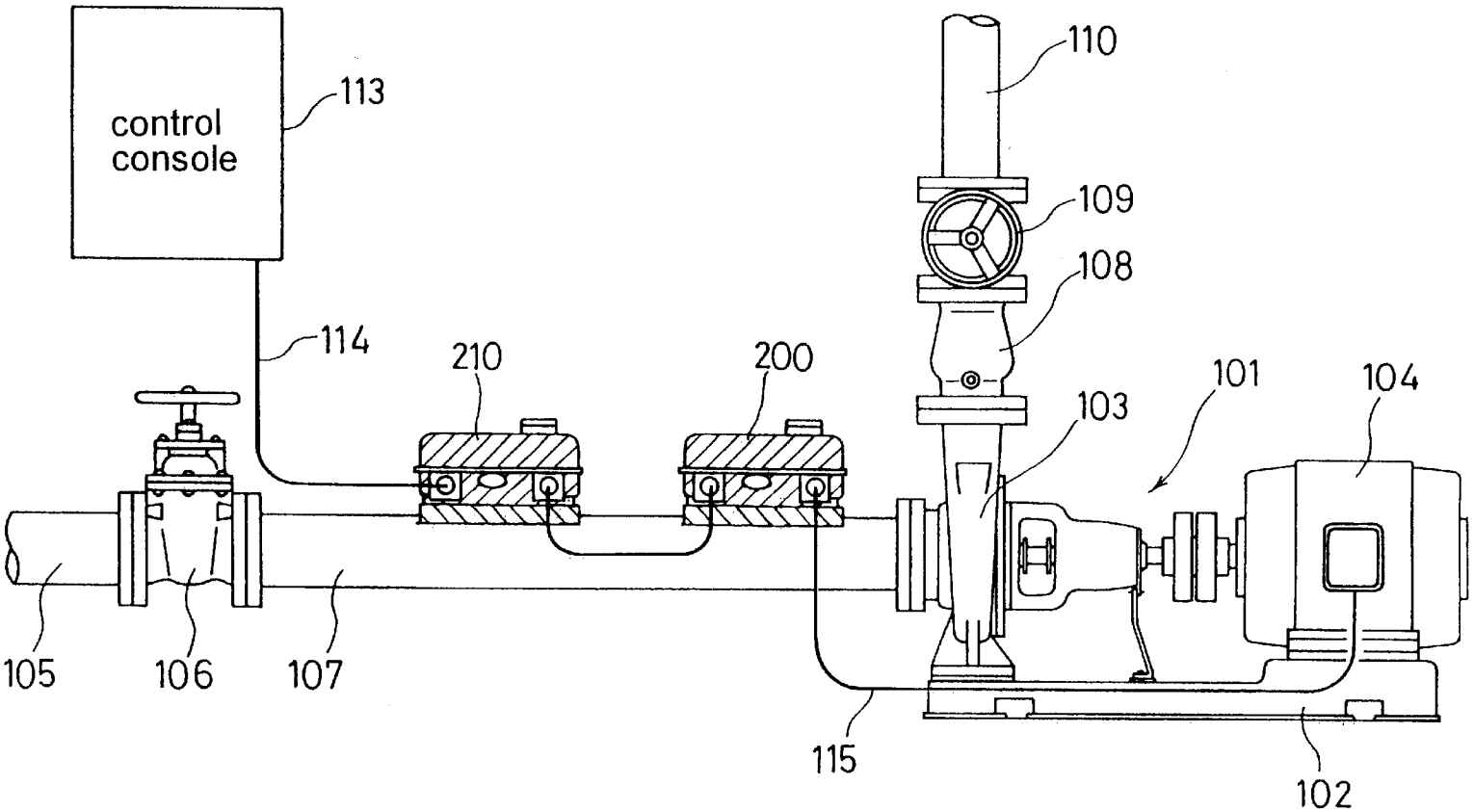
FIG. 18 is an embodiment showing the frequency converter unit and the electric element unit being connected in series with each other.

In an embodiment as shown in FIG. 18, the frequency converter unit 200 is connected in series with an electric element unit 210 comprising of the AC reactor and/or the noise filter.

The casing and the bracket of the frequency converter unit 200 and the electric element unit 210 are the same structure as shown in FIGS. 16A and 16B. The frequency converter unit 200 includes the frequency converter, and the electric element unit 210 includes the AC reactor and/or the noise filter.

The arrangement of the motor pump and the peripheral structure of the pump are the same as that illustrated in FIG. 1.

When the frequency converter unit (performance regulating device) is connected between the existing control console and the motor pump, it is often necessary to take countermeasures against the line noises. In accordance with the present invention, it is unnecessary to make modification on the control console, if it is required to incorporate the noise filter. The line noises can be reduced or eliminated by the electric element unit connected in series with the frequency converter unit disposed on the pipe, thus it is very convenient.

Figure 19:
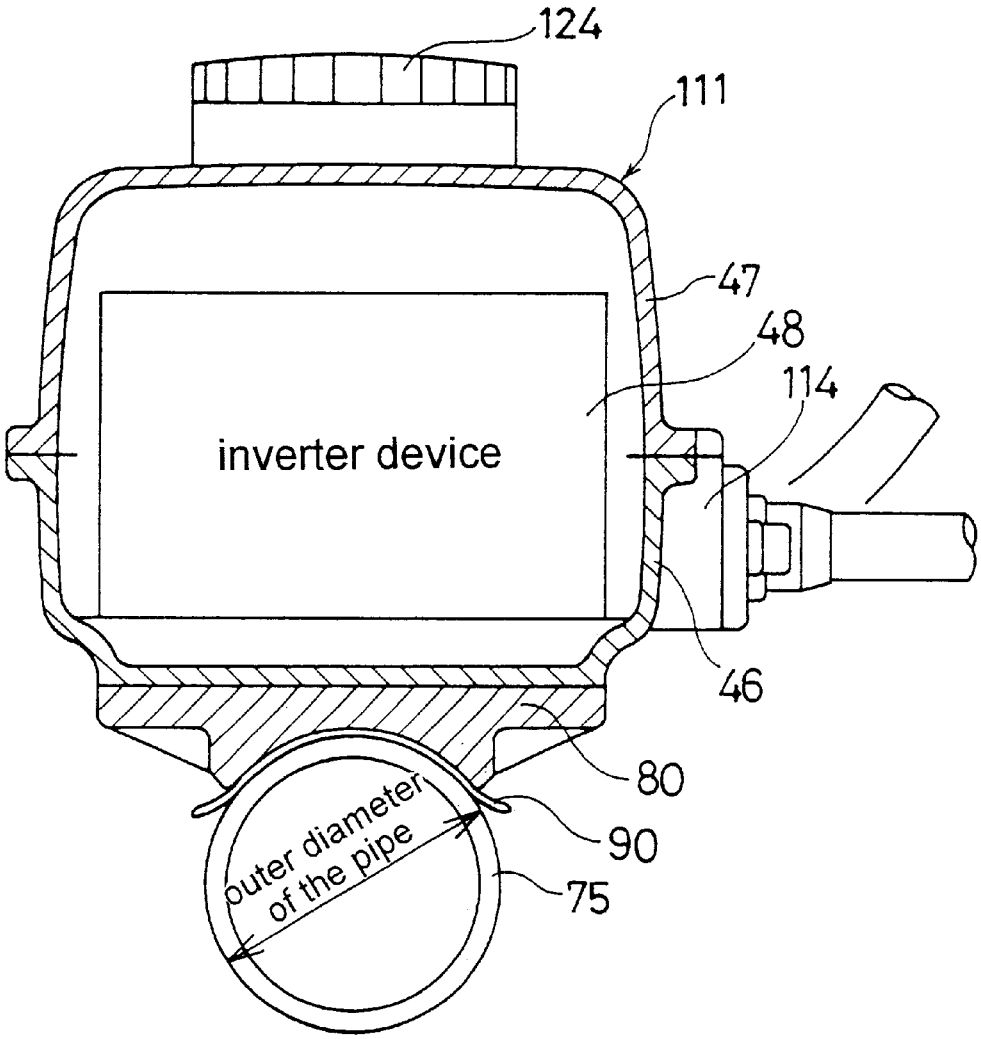
FIG. 19 is a view showing another embodiment of the present invention.
Figure 20A:
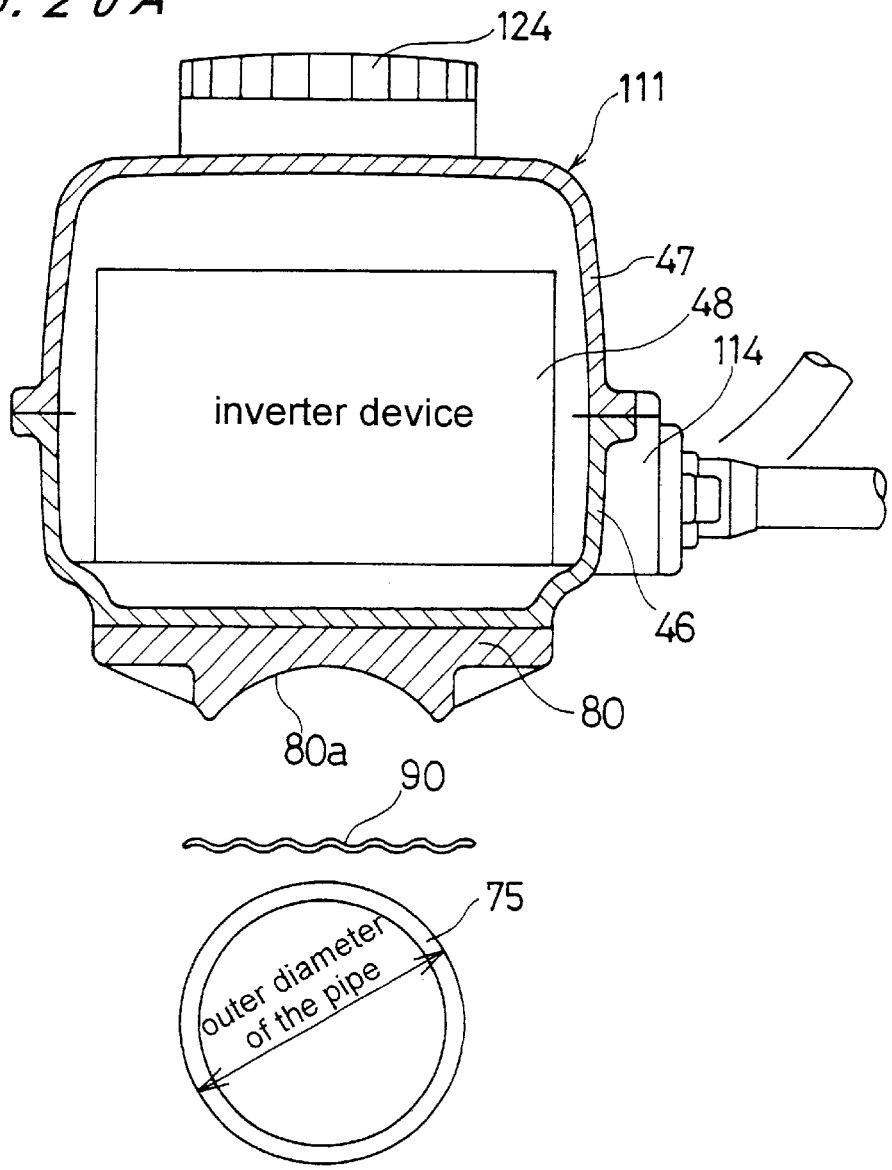
FIGS. 20A and 20B are detailed views of the unit as shown in FIG. 19.
Figure 20B:
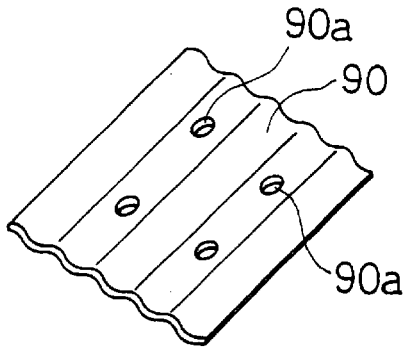

The further embodiment of the present invention will now be described with reference to FIGS. 19, 20A, and 20B. FIG. 19 is a partly cross sectional view corresponding to FIGS. 8A and 8B. FIGS. 20A and 20B are detailed view showing a unit of the structure as shown in FIG. 19. FIG. 20A is an exploded view showing a unit as illustrated in FIG. 19. FIG. 20B is a perspective view of a thin corrugated plate 90. The frequency converter 48 is accommodated within the casing formed by the base 46 and the cover 47. A bracket 80 of aluminium alloy has a curvilinear concave surface 80*a*, which is conformed to the radius of curvature of the pipe 75.

However, the radius of curvature (diameter) of the pipe is varied slightly in each pipe due to the manufacturing tolerance or the flaw or the rust on the surface of the pipe. This variation of the radius of curvature of the pipe will form a clearance between the pipe and the bracket, when the bracket is mounted directly on the pipe. The clearance will cause poor cooling effect, and the degree of cooling effect is varied in each pipe.

In order to eliminate the clearance effectively, the thin plate 90 is interposed between the pipe and the bracket. The thin plate 90 is a plate of cupper having a thickness of 0.2–0.5 mm. The plate can easily be deformed plastically. The thin plate 90 is formed as a thin corrugated plate 90 as shown in FIG. 20A.

After the thin plate 90 is interposed between the pipe and the bracket, the fastening bands 72 (refer FIGS. 17A, 17B) are tightened to increase the pressure generated on the mounting surface between the pipe and the bracket. The plate is thus deformed under the pressure to eliminate the clearance to connect the bracket thermally with the pipe through the larger area therebetween. The heat generated by the inverter device can be transferred effectively to the pipe in spite of the variation of the radius of curvature of the pipe.

In order to enhance the effect of the thin plate, a caulking material such as silicone may be applied on both surfaces of the cupper plate for eliminating the clearance completely to increase the heat transfer. In order to reduce irregularity of the application of the silicone, the thin plate 90 is provided with holes 90*a* as shown in FIG. 20B. As the degree of tightening of the bands 72 are increased, the silicone tends to be spread over both surface of the plate.

Figure 21:
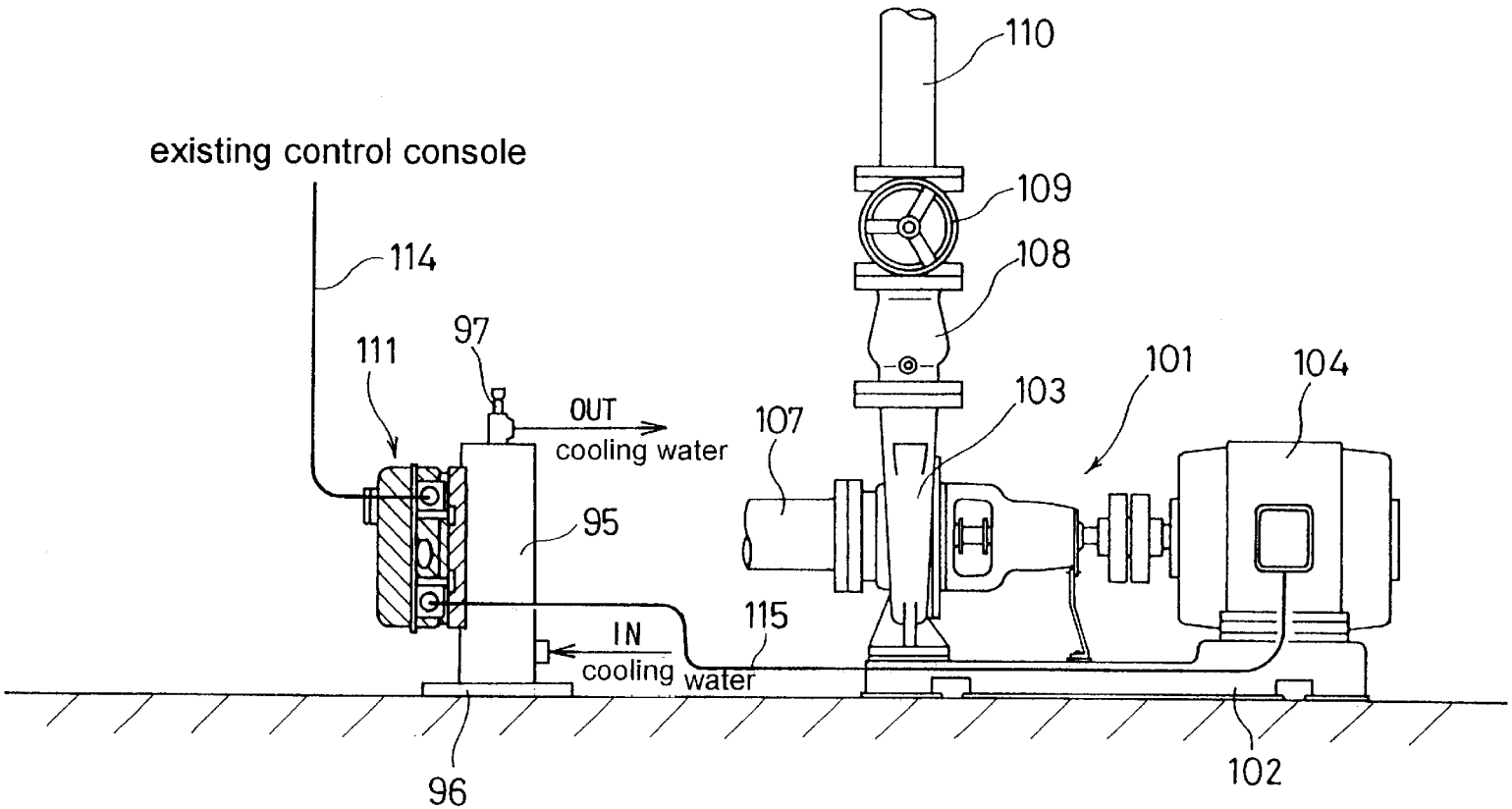
FIG. 21 is a side view showing another embodiment of the performance regulating device of water cooling jacket type.

Another embodiment of the regulating device 111 of the water-cooling jacket type is shown in FIG. 21.

The regulating device 111 is of a vertical type, and is constructed so as to conform with the diameter of the commercially available standardized steel pipe (e.g. SGP). The performance regulating device (frequency converter unit) 111 is mounted around the periphery of the steel pipe. Namely, a base plate 96 is provided on the one end of the commercially available standardized steel pipe 95, and an air vent valve 97 is provided on the other end of the pipe. The cooling water or coolant introduced into the steel pipe 95 through the bottom thereof will absorb the heat from the frequency converter within the regulating device 111, and then flows out through the top portion of the pipe 95. The arrangement of the motor pump and the peripheral equipments around the pump are the same as that illustrated in FIG. 1.

Figure 22A:
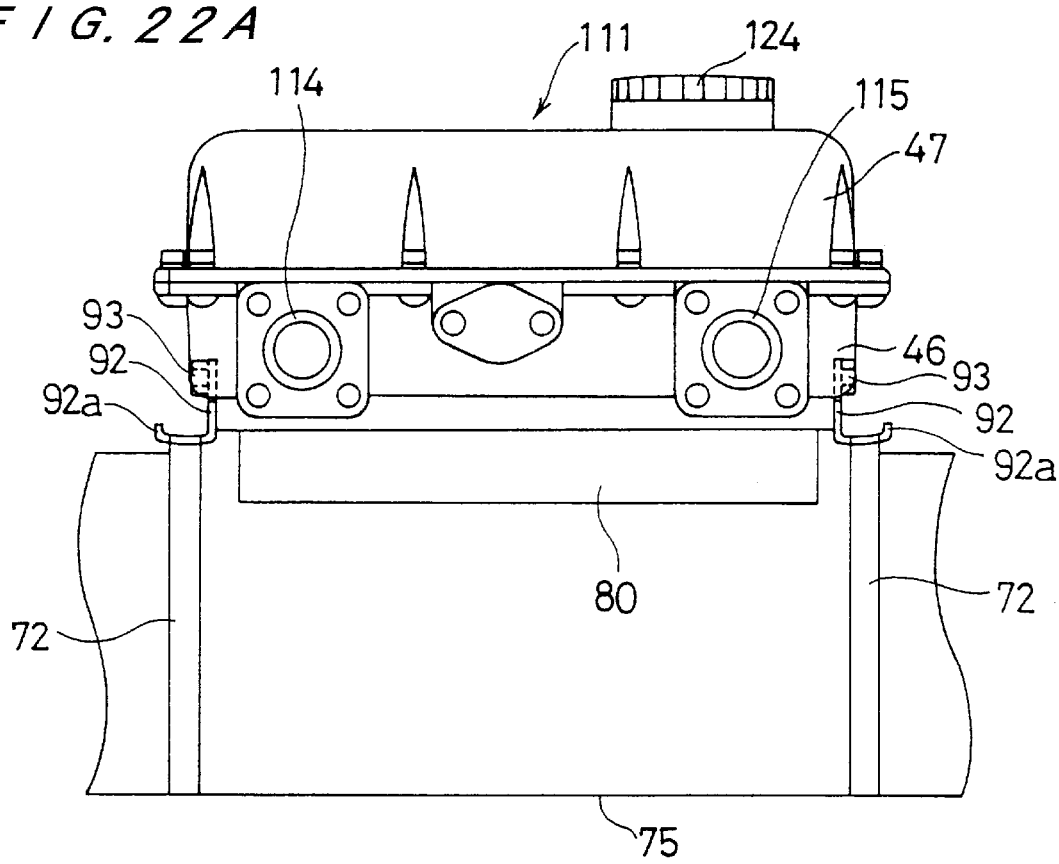
FIGS. 22A and 22B are detailed views showing another embodiment for mounting the performance regulating device.
Figure 22B:
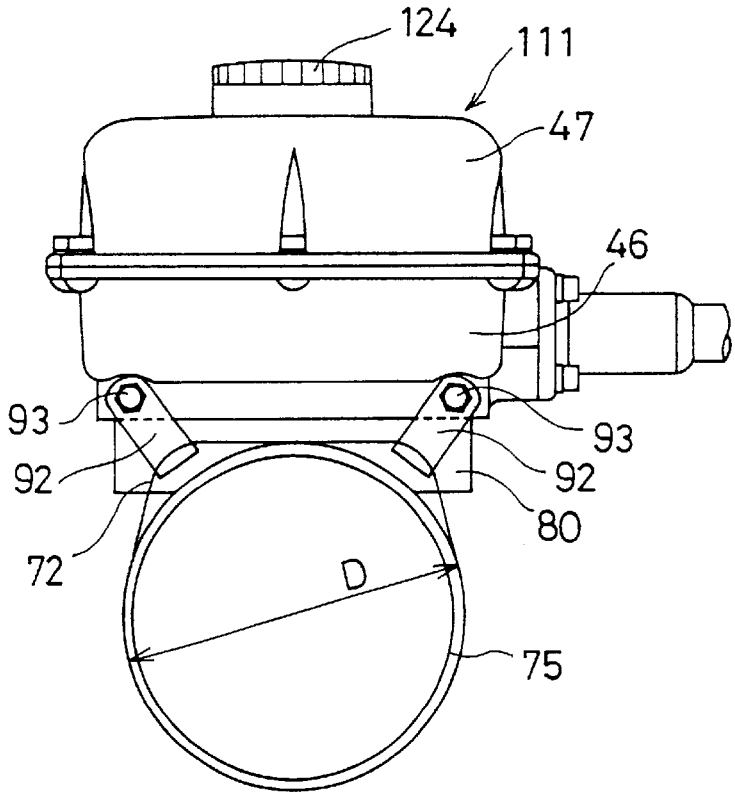

Another embodiment of the method for mounting the performance regulating device 111 is shown in FIGS. 22A and 22B. FIG. 22A is an elevational view and FIG. 22B is a side view.

L-shaped fixtures 92 are connected to the base 46 of the frequency converter by bolts 93. A stopper 92*a* is formed on each L-shaped fixtures 92 to avoid the disconnection of the fastening bands 72. The L-shaped fixtures are formed for example of a plate of stainless steel. The L-shaped fixtures 92 are disposed directing toward the center of the pipe 75 and secured by the bolts 93. The L-shaped fixture 92 is spaced apart at about 2–3 mm from the surface of the pipe 75, so that spring action is given thereby, thus preventing from loosening of the bands.

In accordance with the present invention, a performance regulating device for fluid machinery can be realized, which includes a frequency converter as a main element, and which does not affected by the rain or dew in the out-door circumstances, thus contributing to save energy as described above.

The performance regulating device does not require a motor fan for cooling thereto, which is usually required in general inverter devices, thus resulting to improve reliability. Since various cooling means can be adopted in one regulating device, the regulating device can be installed anywhere depending on the circumstance of the sites.

The rotational speed can easily be changed, so that everybody can participate in saving energy. In the arrangement of the present invention, parts or elements can be used commonly, thus the productivity thereof is high.

The contribution according to the present invention is large for saving energy, as described above.

INDUSTRIAL APPLICABILITY

The present invention can be suitably utilized in the fluid machinery such as a pump for circulating cooled or heated water.

What is claimed is:

1. A performance regulating device for fluid machinery, comprising;

a frequency converter a pump, a casing for housing the frequency converter therein so as to ensure airtight against an atmosphere, input means and output means of electric power provided with the casing so as to ensure airtight against the atmosphere, an output frequency regulating device for controlling an output frequency, and heat radiating means for transferring a heat generated by said frequency converter to a pipe to be connected to said pump through a surface of the pipe.

2. A performance regulating device for fluid machinery as claimed in claim 1, wherein the fluid machinery comprises a motor pump of a turbo type.

3. A performance regulating device for fluid machinery as claimed in claim 2, further comprising;

heat radiating means being provided on said casing, and a flow passage being provided through said heat radiating means for passing a fluid, which is handled by the pump.

4. A performance regulating device for fluid machinery as claimed in claim 1, further comprising;

a heat radiating plate for air cooling being provided on said casing.

5. A performance regulating device for fluid machinery as claimed in claim 1, wherein said output frequency regulating device comprises a stepwise control switch.

6. A performance regulating device for fluid machinery as claimed in claim 1, wherein said casing is used in common with said frequency converter, which is mounted on an outer surface of the pump and cooled by water.

7. A performance regulating device for fluid machinery as claimed in claim 1, wherein said frequency converter begins to output electrical power automatically when electric power is supplied thereto.

8. A performance regulating device for fluid machinery, as claimed in claim 1, wherein said casing of the performance regulating device for the fluid machinery has weather proof structure, which is able to avoid at least an ingress of rain water into the casing.

9. A performance regulating device for fluid machinery as claimed in claim 8, further comprising:

means for preventing condensation of water, which is able to avoid condensation of water substantially within the casing.

10. A performance regulating device for fluid machinery as claimed in claim 8, wherein said casing is formed to ensure airtight against an atmosphere.

11. A performance regulating device for fluid machinery as claimed in claim 8, wherein said casing has a structure on upper side thereof, in which rain water is difficult to enter into the casing but air can flow in or out from the casing.

12. A performance regulating device for fluid machinery as claimed in claim 8, wherein a hole is provided at lower side of the casing.

13. A performance regulating device for fluid machinery as claimed in claim 8, wherein fins are provided for emitting heat on outer surface of said casing.

14. A performance regulating device for fluid machinery as claimed in claim 8, wherein said casing is mounted on a counterpart member by elongated members of a strip shape or a string shape.

15. A performance regulating device for motor pump as claimed in claim 8, wherein when the fluid machinery is a motor pump, the performance regulating device is provided with the motor pump directly or indirectly, and the casing is mounted on a member, through which a fluid to be handled by said motor pump flows.

16. A performance regulating device for motor pump as claimed in claim 15, further comprising:

a mounting bracket for functioning as a size adapting member being interposed between the member through which a fluid to be handled flows and the casing.

17. A performance regulating device for motor pump as claimed in claim 16, wherein said mounting bracket is made of an aluminum alloy having good thermal conductivity.

18. A performance regulating device for motor pump as claimed in claim 16, wherein said mounting bracket is made of an elastic material.

19. A performance regulating device for motor pump as claimed in claim 16, wherein said mounting bracket is made of an elastic material.

20. A performance regulating device for fluid machinery as claimed in claim 16, wherein an attaching member having spring effect is provided for maintaining the casing and the pipe being contacted tightly with each other.

21. A performance regulating device for fluid machinery as claimed in claim 16, wherein the casing is commonly used for the casing of a performance regulating device.

22. A performance regulating device for fluid machinery as claimed in claim 16, wherein an electric element unit and a frequency converter unit are connected in series through the electric power input means and output means of these units.

23. A performance regulating device for fluid machinery as claimed in claim 22, wherein the electric element comprises an AC reactor for reducing harmonics or a noise filter for reducing line noises.

* * * * *